US009815611B2

(12) United States Patent
Reinhold et al.

(10) Patent No.: US 9,815,611 B2
(45) Date of Patent: Nov. 14, 2017

(54) DEVICE AND METHOD FOR SINGULARIZED DISPENSING OF SOLID PORTIONS

(71) Applicant: BALDA MEDICAL GMBH & CO. KG, Bad Oeynhausen (DE)

(72) Inventors: Thomas Sowden Reinhold, Bad Oeynhausen (DE); Philipp Sawitzki, Ingolstadt (DE)

(73) Assignee: BALDA MEDICAL GMBH & CO. KG, Bad Oeynhausen (DE)

( * ) Notice: Subject to any disclaimer, the term of this patent is extended or adjusted under 35 U.S.C. 154(b) by 0 days.

(21) Appl. No.: 14/900,983

(22) PCT Filed: Jun. 30, 2014

(86) PCT No.: PCT/EP2014/063884

§ 371 (c)(1),
(2) Date: Dec. 22, 2015

(87) PCT Pub. No.: WO2015/000861

PCT Pub. Date: Jan. 8, 2015

(65) Prior Publication Data

US 2016/0145031 A1 May 26, 2016

(30) Foreign Application Priority Data

Jul. 2, 2013 (DE) ..... 10 2013 212 910

(51) Int. Cl.
*G07F 11/00* (2006.01)
*B65D 83/04* (2006.01)
(Continued)

(52) U.S. Cl.
CPC ..... *B65D 83/0409* (2013.01); *A61J 1/03* (2013.01); *A61J 7/02* (2013.01)

(58) Field of Classification Search
CPC ... A61J 1/03; A61J 7/02; A61J 7/0076; B65D 83/0409; B65D 83/04
(Continued)

(56) References Cited

U.S. PATENT DOCUMENTS 5,377,614 A * 1/1995 Glazer ..... G09F 11/23 116/308
2004/0191313 A1* 9/2004 Moest ..... A61J 7/0023 424/470
(Continued)

FOREIGN PATENT DOCUMENTS

CA 2522791 C * 5/2007
DE 2822581 A1 11/1979
(Continued)

*Primary Examiner* — Rakesh Kumar
(74) *Attorney, Agent, or Firm* — Frank J. Bonini, Jr.; John F. A. Earley, III; Harding, Earley, Follmer & Frailey, P.C

(57) ABSTRACT

A device and a method for singularized dosing of solid portions F, in particular mini or micro tablets or globules, which solid portions are forming a bulk body S situated at least partially in the device. The device comprises at least two components, a first component of which is a segregating device and a second component of which is a singularizing device that can be twisted vis-à-vis the segregating device. The singularizing device comprises an interior area and on its inner side at least one chamber for accommodating one solid portion F at a time, so that the at least one chamber can be moved in a direction of motion D and on a motion path B through the bulk body S during twisting of the singularizing device vis-à-vis the segregating device. The segregating device further comprises a separating device to prevent solid portions F contained therein drop out.

20 Claims, 21 Drawing Sheets

Figure 1:
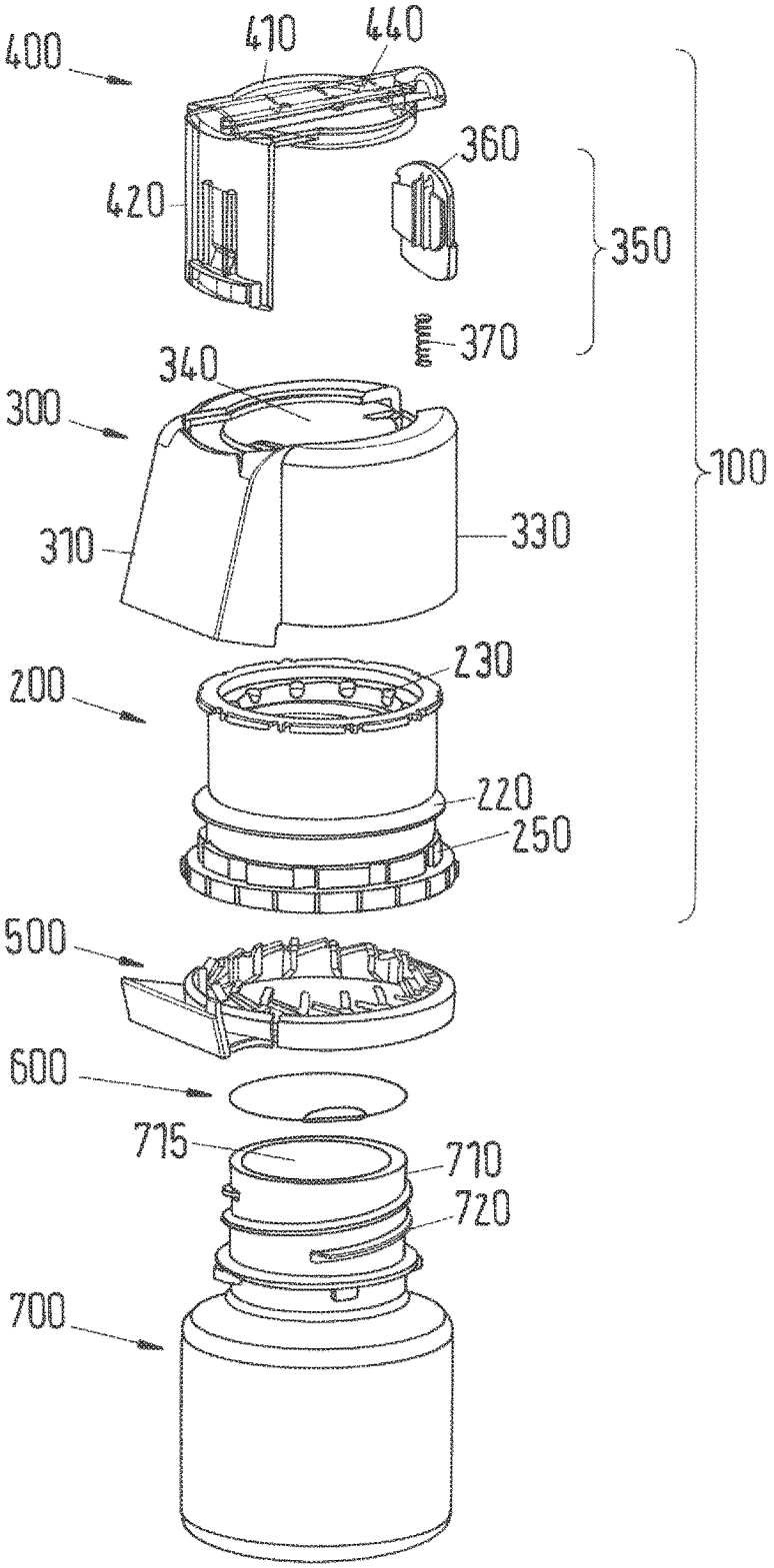

(51) Int. Cl.
*A61J 1/03* (2006.01)
*A61J 7/02* (2006.01)

(58) Field of Classification Search
USPC ..... 221/69, 7, 12, 13
See application file for complete search history.

(56) References Cited

U.S. PATENT DOCUMENTS

| | | | | |
|---|---|---|---|---|
| 2007/0007301 | A1* | 1/2007 | Kaplan | G07F 17/0092 221/288 |
| 2016/0145031 | A1* | 5/2016 | Reinhold | B65D 83/0409 221/1 |

FOREIGN PATENT DOCUMENTS

| | | | | |
|---|---|---|---|---|
| DE | 3721518 | A1 * | 1/1988 | A47J 47/01 |
| DE | 202004021462 | U1 * | 3/2008 | A61J 7/0023 |
| WO | WO 89/01448 | A1 | 2/1989 | |
| WO | WO 8901448 | A1 * | 2/1989 | B65D 83/0409 |
| WO | WO2010/060568 | A2 | 6/2010 | |
| WO | WO 2010060568 | A2 * | 6/2010 | A61J 7/0076 |

* cited by examiner

I-I

DEVICE AND METHOD FOR SINGULARIZED DISPENSING OF SOLID PORTIONS

BACKGROUND OF THE INVENTION

1. Field of the Invention

The present invention relates to a device and a method for singularized dispensing of solid portions forming a bulk quantity. Such devices and methods are typically utilized for pharmaceutical solid dosage forms in the form of drug portions, such as tablets, coated tablets, pills, capsules, globules (spherules), mini and micro-tablets and others, for example. The invention can also be used for dispensing solid portions for other purposes, such as nutritional supplements, vitamin preparations and build-up preparations.

A dispenser is particularly useful for counting of mini and micro-tablets and globules, where the dispenser releases not only one but multiple such solid portions controlled in a defined number, so that a predefined quantity of such type of small-scale dosage forms can also be easily separated and taken by any users.

2. Brief Description of the Related Art

A system for the provision of a pharmaceutical form of administration for at least one active substance with pharmaceutical auxiliary additives and their uniform and consistent dosage is stated in DE 20 2004 021 462 U1. The system includes a dispensing device that is matched to the individual single dosage for a patient and interacting functionally with the dispensing device for the administration in form of solids. In one of the illustrated embodiments, the dispensing device includes a dosing container (a primary packaging), which contains the solids. A pipe length is disposed between an outer wrapping and an inner wiper of the dosing container, which pipe length itself has portioning areas for the solids. The portioning areas are filled respectively with one solid from the inner area of the dosing container in the area that is not covered by the wiper. By rotating the pipe length by means of an actuation device, the respectively filled portioning area is separated by the wiper from the interior of the dosing container and fed to an ejection opening. The ejection opening can for example be covered by a closure in the form of a receiver. Markings for the portioning quantities are applied on the internal pipe length, which markings are visible from outside.

A manually operated dispensing device is furthermore disclosed in WO 2010/060568 A2, which comprises a storage chamber and a dispensing area as well as a feed unit in a container, which feed unit connects the storage chamber and the dispensing area. The feed unit serves for the singularized supply of drug units into the dispensing area. The feed unit is developed by a feed wheel with feed pockets, which during its rotation carries along respectively one drug unit in the pockets and feeds it to the dispensing area. The feed wheel is rotated by an electronically controlled motor.

The known devices for dosing of solid pharmaceutical forms of administration and other solids are either not very reliable with respect to the dosing of a specific number of solid units, however, or require substantial expense during their production, use and disposal. In particular the dispensing device from WO 2010/060568 A2 requires an electronic control and a motorized drive so that the feed unit can be operated. As a consequence, the use and also the disposal are complex and costly after the use of this dispensing device. Moreover, the type of dispensing the solid portions with the known devices and methods is in particular uncertain when mini and micro-tablets or (micro-)globules are to be administered in a defined larger number, because this can easily result in incorrect dosing. Dispensing solid portions with the known devices requires additionally that these are transferred from a primary package, for example from a tablet storage container, into the device. Such transfer into a dosing vessel can result in impairing the quality of the pharmaceutical units of presentation, however.

SUMMARY OF THE INVENTION

The object of the present invention therefore is to find a device and a method with which safe and easy dispensing of solid portions is possible. The device should also have a simple design and structure, with low complexity. The method must be easy to implement and cost-effective. Ultimately, the invention should preferably also ensure that solid portions present in the primary package do not have to be transferred into a separate device for dispensing.

According to a first aspect of the present invention, the above problem is solved by the device according to the invention for singularized dispensing of solid portions forming a bulk body. This device is developed from at least two components, where a first component of which is a segregating device and a second component opposite the segregating device forms a rotatable singularizing device. Each of these components on its part can be developed from multiple component parts. The dispensing device according to the invention can be developed for accommodating the bulk body of the solid portions. The one component of the dispensing device, specifically the singularizing device, has an interior area. An interior space in the dispensing device which accommodates the bulk body at least partially, can be formed by the interior area of the singularizing device. Alternatively, the interior space accommodating the bulk body at least partially can be developed additionally by other components in the dispensing device. At least one chamber or at least one cup for accommodating one single solid portion in each case is provided on the inner side of the singularizing device. As a result, the at least one chamber can be moved in a direction of motion and on a motion path through the bulk body during a rotation of the singularizing device vis-à-vis the segregating device. By the movement of the chambers through the bulk body, in each case a single solid portion is accommodated in these chambers. It is assumed that the solid portions are also placed into motion during the rotation of the singularizing device, so that the solid portions adhering on the inside wall of the singularizing device are placed into a suitable position and alignment for the accommodation in the chambers. Furthermore, the other component of the dispensing device, i.e. the segregating device, has a separating device. This extends parallel to a path section of the motion path of the at least one chamber up to an area above the bulk body (when holding the device during the actuation, i.e. in the actuation position of the device), in such a way that the at least one chamber on the path section opposite the interior area or interior space is closed by the separating device. This prevents solid portions contained in the chambers from dropping out of the chambers during the rotation. A transfer path for accommodating the solid portions dropping out of the chambers and for withdrawing the accommodated solid portion from the interior area or interior space connects onto the path section in the direction of motion. This transfer path can in particular be a component of the segregating device. For this purpose, the transfer path is preferably in a fixed spatial relationship to the path section of the chambers above the bulk body and to the separating device, so that the solid portions leaving the chambers can be transferred easily onto the transfer path.

According to a second aspect of the present invention, the above problem is solved also by the method according to the invention for singularized dispensing of solid portions forming the bulk body. This method can be performed in particular by using the device according to the invention for singularized dispensing of the solid portions. The method includes at least the following process steps:

(a) The bulk body of the solid portions is provided initially, so that the bulk body is located at least partially in the interior area of the singularizing device of the dispensing device according to the invention; for example, the dispensing device can be connected to a primary package, for example to a storage container like a tablet bottle, in which the bulk body of the solid portions is located, wherein at least a part of the bulk body comes into contact with the interior area of the singularizing device; for example, the dispensing device can be developed so that a bulk body of the solid portion forms in it or in a discharge spout attached on the primary package, in that the primary package is put on the side (tilted) such that the solid portions from the primary package arrive in the dispensing device and form the bulk body there; the solid portions thus reach the area of the chambers; in order to place the primary package into a correct orientation with the dispensing device, a supporting surface can be provided on the dispensing device, on which supporting surface the dispensing device is placed onto a base.

(b) Thereafter, in each case a single solid portion is accommodated in one of multiple chambers, which are located on the inner side of the singularizing device; for this purpose, the singularizing device with the chambers is turned (in particular rotated), so that the chambers are moved through the bulk body.

(c) Because of the turning (in particular rotation) the chambers, each of which are filled with a solid portion, are lifted successively out of the bulk body.

(d) The chambers, each one filled with a solid portion, are emptied following their respective lifting out of the bulk body, and the solid portions are transferred onto a transfer path. The solid portions that have arrived on the transfer path can be brought out of the interior area of the singularizing device, for example.

The device according to the invention and the method according to the invention serve in particular for singularizing and dispensing mini and micro-tablets. Mini and micro-tablets are tablets with a size (a diameter) of 1 to 3 mm. They typically have convex upper sides and bottom sides. The size ratio of their height to their diameter is usually in the range from 1 to 1.5. The dispensing device according to the invention is characterized by a simple structure with few components. Despite its simplicity, very reliable dispensing of solid portions is possible from a bulk body of these portions.

The device according to the invention and the method according to the invention represent a dispensing aid for solid portions, in particular of mini and micro-tablets and globules, in order to attain reliable singularizing and dispensing of solid portions. A defined number of solid portions can be singularized, counted and dispensed by means of the device according to the invention and the method according to the invention. Preferably, the assembly of the dispensing device according to the invention in terms of external appearance can be very similar to a traditional cap of a tablet bottle (when the dispensing device is connected to the storage container, in order to singularize and dispense the solid portions present in the storage container) or with a conventional tablet bottle with its cap (if the dispensing device is used without storage container). The dispensing device can be fitted onto the bottle or onto another storage container instead of a cap, for example. The dispensing device constitutes a dispensing aid and can therefore be sold and used separately or together with a filled tablet bottle. The dispensing device according to the invention can be connected to the storage container instead of to a cap.

The singularizing device is preferably developed in form of an essentially axisymmetrical body, which preferably has an essentially axisymmetrical interior area. The singularizing device can be developed in form of a drum or a wheel or ring or a surrounding band, for example. For purposes of the present invention it is not necessary that the singularizing device is axisymmetrical, however. Also structural solutions are conceivable with a singularizing device that is not axisymmetrical, with an interior area and with chambers opening to the interior area for accommodating the solid portions, provided that the chambers can be moved through the bulk body, provided that the solid portions accommodated by the chambers are prevented by the separating device from dropping out of the chambers on the subsequent path section, and provided that the solid portions arrive on the transfer path after leaving the path section. It would be conceivable, for example, that the chambers lie on a circular segment and cover a circular path during a rotation of the singularizing device.

The singularizing device and the segregating device are preferably connected with one another by means of a positive joint, for example by means of a locking connection. The receiving device (see below) can have an arm with a snap lug, for example, which engages on the singularizing device by means of a snap ring and in this context abuts on a frontal part on the front face of the segregating device while holding it at the same time, in that it clamps the segregating device between itself and the singularizing device. The segregating device can alternatively be developed by two component parts connected to one another, between which the singularizing device is held in the assembled state.

The chambers for accommodating the solid portions are preferably located on the inner side of the singularizing device. During a rotation of the singularizing device about a rotational axis, which in particular can be the rotational axis of an essentially axisymmetrical hollow body, wheel or ring, the chambers are moved on a motion path which extends concentrically to the rotational axis. In the case of a hollow body, the solid portions (at least also) in this form a bulk body and fill said hollow body up to a specific level in longitudinal direction, for example, i.e. essentially parallel to the rotational axis, preferably (in the actuation position of the device according to the invention) slightly inclined to the horizontal. Alternatively, the interior area of the singularizing device developed in form of a wheel or ring, can also be filled up to a specific level during use. The rotational axis of the singularizing device can be positioned horizontally for the singularizing and dispensing of the solid portions, i.e. essentially horizontal or somewhat inclined towards the horizontal. During the rotational, the chambers go past the bulk body, so that in each case a solid portion is accommodated by one of the chambers. During twisting of the singularizing device, the chambers are lifted out of the bulk body and are carried up to the transfer path, so that the solid portions contained in the chambers arrive on the transfer path from the respective chamber. To prevent the solid portions from falling out of the chambers after being lifted out of the bulk body area, the separating device is positioned opposite the path section above the bulk body area, which separating device closes the chambers on this path section. So that this separating device can close the chambers on a defined path section, this device is not moved along together with the chambers of the singularizing device and is therefore a constituent part of the second component, i.e. the segregating device, opposite of which second component the singularizing device is twisted during the use of the dispensing device. The segregating device is accordingly not moved during the use, while the singularizing device is twisted.

The function of the singularizing device therefore consists in singularizing the solid portions from one another. The function of the segregating device consists in segregating the solid portions contained in the chambers from the bulk body thereafter and keep them in the chambers, so that they do not drop back again into the bulk body.

The segregating device moreover includes the transfer path, by means of which the solid portions in the chambers are carried out of the interior area of the singularizing device. For this purpose, the solid portions arrive at the transfer path above the path section, in which the separating device extends along the motion path of the chambers. The point at which the solid portions reach the transfer path, can be selected differently: in the position of use of the dispensing device, this point can be close to the zenith or at the zenith of the rotary motion. In this case, the solid portion can drop onto the transfer path by gravity. This naturally assumes that the separating device extends up to this point or close to it, to prevent premature dropping out of the solid portions from the chambers. On one end of an outlet, at which the solid portions from the chambers arrive, the transfer path is preferably expanded in the form of a cone and at this point forms a feed cone or a feed ramp, in order to ensure that the solid portions can reach this position safely. The feed cone or the feed ramp preferably transitions seamlessly into the transfer path. The transfer path leads out of the interior area of the singularizing device, for example in an essentially axial or radial direction.

In a preferred refinement of the present invention, the transfer path terminates in a receiver for accommodating and counting the solid portions. For this purpose, a separate receiving device can form or include the receiver. The receiver can preferably be an elongated cavity for accommodating the singularized solid portions and be in particular developed in form of a dosing tube. In the position of use of the dispensing device, the elongated cavity can preferably be aligned vertical or at a small angle (±30° maximum) to the vertical. The transfer path terminates in the cavity. The receiving device with the receiver can be disposed on a front face of the dispensing device, for example. This permits a compact structural design of the dispensing device according to the invention. The solid portions can be easily released from the receiver. The solid portions are collected in the receiver, so that a user can count the released solid portions there. This permits secure dosing of the portions. For this purpose the receiver is designed such that the user can see the solid portions in the cavity.

To further ensure that the user can count the solid portions in the receiver easily, said receiver in a further preferred refinement of the present invention is developed to permit stacking of the solid portions individually and on top of each other. For this purpose, the receiver is preferably developed tubular while forming a receiving duct. In this context, the tube diameter preferably corresponds approximately to the diameter of the solid portions and is slightly larger than the diameter of the solid portions, so that it is mandatory that they are stacked on top of each other and are collected and stored in this manner. This makes counting easier for the user. The receiver can have a slot in its wall for the user to be able to distinguish the solid portions contained therein, for example. However, it is more preferred, if the receiver is made of a transparent material through which the solid portions are easily visible from outside.

In a further preferred refinement of the present invention, a dosing scale is on the receiver, by means of which the number of the solid portions in the receiver can be read. This scale graduation in each case incrementally marks one individual solid portion or a group of solid portions, which are contained in the receiver, for example a group of five or ten or even more solid portions. In this way, it is possible to determine the number of solid portions in the receiver at a glance, without the complicated procedure of having to count which is subject to errors.

In a further preferred refinement of the present invention, an adjustable for example traversable reading device, for example a slider, is attached on or in the receiver. The reading device can be fitted-on outside to merely mark the filling level with the solid portions, or be inserted into the dispensing tube, for example from below, so that the available space therein is limited. Using this device, a user can determine desired dispensing of a specific number of solid portions to be taken, or at least be able to read it easily. The user positions this reading device on or in the receiver at the desired position, which marks a specific filling level of the receiver with the solid portions, and can then during the dispensing of the solid portions with the dispensing device according to the invention determine without difficulty at a glance whether the desired number of solid portions is present in the receiver.

In a further preferred refinement of the present invention, the receiver furthermore has an outlet opening for removing the solid portions present in the receiver. During singularizing and dispensing, this outlet opening is either on the top end or at the bottom end of the receiver in the actuation position of the dispensing device. If the receiver is developed as an elongated cavity, this can be open at the top or at the bottom for this purpose. For removing the singularized and released solid portions, in the first case the dispensing device is preferably turned around (release position) for the solid portions to drop out. Preferably, the upper opening for removing the solid portions expands outwards, so that it forms an outlet cone there. If the receiver is open to the bottom, a portion barrier is provided which prevents that the solid portions (in the actuation position) during segregating drop down into the receiver. After segregating the desired number of solid portions, this portion barrier is disengaged (in the release position), so that the solid portions can then drop down and therefore be removed.

In a further preferred embodiment of the invention, the receiver is supported pivoted in the device, preferably about a rotational axis that is essentially horizontal in the position of use of the device, wherein the receiver is in an actuation position for singularizing the solid portions and for transferring into the receiver in a central swivel position and for actuating the device for left-handed or right-handed persons is in respectively a release position for releasing the solid portions from the device in a first lateral swivel position, which with respect to the actuation position is tilted in a first swivel direction, or is in a second lateral swivel position, which with respect to the actuation position is tilted in a second swivel direction. The first and the second lateral swivel position are preferably reciprocally opposite. By means of this preferred embodiment, the dispensing device according to the invention can be operated both by left-handed as well as right-handed persons. To release the solid portions contained in it, the receiver must simply be swiveled from the central swivel position into the appropriate lateral swivel position, using the respective hand. The fulcrum, about which the receiving duct is swiveled, is preferably in an area positioned in the top of the receiver in the position of use of the dispensing device.

In a further preferred embodiment of the present invention, an overflow route for the solid portions is located (in the position of use of the dispensing device) above the receiver, by means of which these solid portions can arrive at the bulk body. This overflow route is connected to the transfer path from the chambers into the receiver, so that the solid portions can also arrive on the transfer route during the transfer into the receiver. With this embodiment it is prevented that the solid portions are blocking during transfer into the receiver, if this is already filled up completely. Moreover, by a specified (maximum) capacity of the receiver for a specific number of solid portions, in this manner it can be accomplished that this (maximum) number of solid portions is always exactly released without closer observation of the filling operation, since any excess solid portions will be returned automatically to the bulk body.

In a further preferred refinement of the present invention, the singularizing device and the segregating device in a first embodiment variant are hollow bodies with a longitudinal axis, which hollow bodies are preferably at least partially axisymmetrical. The longitudinal axes preferably coincide in this embodiment variant. Furthermore, the motion path of the at least one chamber lies on a circular trajectory in a plane perpendicular to the longitudinal axis. In one (other) second embodiment variant, both the singularizing device as well as the segregating device each have a rotational axis, which do not coincide, however. Preferably, the one axis is rather positioned essentially perpendicular on the other. Although the motion path of the at least one chamber lies preferably also in one plane. However, this plane in this embodiment variant is preferably aligned parallel to the axis of the segregating device.

In a further preferred refinement of the present invention, the at least one chamber of the singularizing device is preferably formed by a groove on the inner side (inside wall) of the singularizing device. The chambers are preferably approximately the same size as the solid portions and have approximately the form of the solid portions, so that each chamber can accommodate only exactly one solid portion. The chambers are preferably slightly larger, i.e. their respective outline and their corresponding perpendicular cross-sectional projection in each case are approximately 10% larger than that of the solid portions, for example.

If the singularizing device has multiple chambers, these are preferably disposed in a plane, which during the operation of the dispensing device is particularly preferably disposed fixed in the space. The chambers are furthermore preferably disposed regularly, i.e. with identical spacing between adjacent chambers (or at identical angular spacing relative to a rotational axis of the singularizing device). If the singularizing device is formed by a wheel or by a ring with an essentially axisymmetrical inner side or at least with an axisymmetrical section of the inner side and with multiple chambers in this axisymmetrical inner side or with this axisymmetrical section, the chambers can preferably lie on a plane intersecting the inner side or the section perpendicular to the rotational axis of the wheel or the ring, i.e. on a peripheral line of the inner side or of the section. In this case, the chambers move on a fixed circular motion path, wherein they are moved on this motion path through the bulk body of the solid portions on a rotational axis of the singularizing device that is at least essentially horizontal because of a rotation of the device, while said chambers accommodate one solid portion in each case. This also applies accordingly if the singularizing device is a hollow body with an essentially circular cylindrical inside wall or at least with a circular cylindrical section of the inside wall and with multiple chambers in this inside wall or in this section.

In a further preferred refinement of the present invention, areas on the inner side of the singularizing device are formed by running surfaces for the solid portions, which running surfaces are located between the chambers. These running surfaces extend from a higher-level above a chamber base in a respective first chamber to a lower level above a chamber base of a second chamber that is adjacent to the first chamber in a direction of rotation of the singularizing device. In this way, ramps are formed between each two adjacent chambers along these running surfaces. In this manner, during the rotation of the singularizing device it is prevented that two solid portions attempt at the same time to arrive in one chamber, even though the chamber size is insufficient: in the event that this refinement would not be realized, these two solid portions located at the chamber inlet would block the further twisting of the singularizing device vis-a-vis the segregating device, so that the application of an increased torque would result in compression or even destruction of the additional solid portion. Because in this case, this solid portion would be jammed between a wiper edge at the chamber inlet and the first solid portion that is already located in the chamber. The present refinement of the invention therefore prevents that subsequent solid portions could snag behind this first solid portion, if a first solid portion is already present in a chamber. The subsequent solid portions would instead be passed above the occupied chamber.

The running surfaces between adjacent chambers can preferably extend straight along the path which runs on the inner side of the singularizing device above the chambers. The running surfaces forming the ramps respectively decline between the chambers in the direction of rotation. This results in that the depth of the chambers is different on each side of the chambers: on the side of the chamber, at which the level of the running surface is high above the chamber base, this level is preferably located above a solid portion contained in the chamber, i.e. the depth of the chamber is greater at this side of the chamber than the diameter of the solid portions, preferably greater by maximum 10% of the diameter. On the other side of the side of the chamber, at which the level of the running surface is low above the chamber base, this level is located at the height of approximately ⅔ of the diameter of the solid portions above the chamber base. If the solid portions are bodies with existing opposite convex (lenticular) outside surfaces, for example, the level in the position of use is preferably approximately at the height of the transition of the convex outer surface which lies on top relative to the residual body of a solid portion that is present in the chamber. The length of the running surface (ramp) between two adjacent chambers furthermore corresponds preferably to at least the diameter of the solid portions. The length can correspond up to 20 times, preferably 10 times, even more preferably seven times, and even still more preferably five times the diameter of the solid portions, for example. Ideally, this length is approximately three times the diameter.

In a further preferred refinement of the present invention the separating device is formed by a partition wall. This partition wall extends along the motion path of the chambers on a section, which extends above the bulk body of the solid portion up to the position on the motion path, from which the solid portions arrive on the transfer path. The partition wall is preferably curved. With an axisymmetrical or circular cylindrical inner side or inner wall or axisymmetrical inner side section or circular cylindrical inner wall section, the partition wall forms a circular section. Preferably, the partition wall on the section is developed circular. The partition wall lies preferably at a small distance from the chambers on their motion path. In principle, the partition wall can rest on the inner side or inside wall of the singularizing device also without spacing, so that the inner side or inside wall and the partition wall move frictionally to one another. The partition wall is preferably approximately as wide as the chambers, i.e. it is slightly wider, slightly narrower than or exactly as wide as the chambers. It is merely important that the partition wall prevents the solid portions from dropping out of the chambers. Instead of a partition wall, also an obstacle having a different shape than a wall can be used as separating device. A curved rib or a curved rod is conceivable.

In a further preferred refinement of the present invention, the dispensing device according to the invention is developed to be connected to a discharge opening of a storage container for the solid portions. For example, either the singularizing device or the segregating device can be designed in form of an adapter for connecting the dispensing device onto the storage container, for example by means of its discharge spout. Alternatively, also another component of the dispensing device can be developed for that purpose. This permits direct use of the storage container for feeding the solid portions to the dispensing device according to the invention. As a result, these solid portions do not have to be transferred into a separate vessel, which could have been developed by the interior space of the dispensing device according to the invention. In this case, the dispensing device according to the invention is fitted onto the storage container and is connected with same instead of a cap. In this case, the dispensing device can be connected to the discharge opening either after removing the cap or it is supplied to the user already connected with the discharge opening instead of the cap.

In all the aforementioned cases, the discharge opening of the storage container is typically closed with a sealing foil, which represents a vapor and oxygen barrier, for example by hot application of the foil onto the opening to prevent exposing the solid portions to unsuitable conditions during transportation and during storage (long-term protection). During subsequent connection of the dispensing device according to the invention with the discharge opening, this sealing foil is initially removed by pulling it off before the dispensing device is fitted on. In particular, if the dispensing device is supplied to the user already fitted to the discharge opening, this sealing foil is intended to protect the solid portions against improper conditions during transportation and during storage. In this case, the dispensing device sits above the sealed discharge opening. The sealing foil must therefore be removed prior to first use. For this purpose, the dispensing device is initially removed from the storage container, then the sealing foil is pulled off, and finally the dispensing device is re-fitted onto the storage container.

For attaching the dispensing device to the discharge opening of the storage container, the discharge opening can have a thread as an adapter, preferably an internal thread. This thread can be present on one of the component parts of the dispensing device, for example on the singularizing device or on the segregating device, or on still another component. For connection, the discharge spout of the storage container has a thread, preferably an external thread. The storage containers typically have external threads onto which a cap can be screwed. The dispensing device is then screwed-on instead of the cap. Instead of a screwed connection between the dispensing device and the storage container, also another connection technique, for example a latch connection, can be selected.

In a further preferred refinement of the present invention, the twisting of the singularizing device vis-à-vis the segregating device can be blocked by means of an anti-rotation stop. In this way, this ensures on the one hand that solid portions will not be dispensed accidentally with the dispensing device. On the other, this anti-rotation element also forms a child safety lock, if said anti-rotation stop is designed such that it has to be intentionally activated during the twisting of the singularizing device vis-à-vis the segregating device, for example by pushing it back or by pressing it in. For this purpose, in a further preferred refinement of the present invention, the anti-rotation stop is formed by or comprises a locking element, which can be actuated for example by means of a locking knob in form of a sliding element or in form of a probe that can be swiveled about an axis. In this refinement, this locking element is attached torsion-proof on one of the two components of the dispensing device and blocks the reciprocal twisting of the two components by means of at least one profile engaging into corresponding cutouts on the respective other component. Preferably, the locking element is attached on the segregating device and is developed to prevent the twisting of the singularizing device vis-à-vis the segregating device.

In a further preferred refinement of the present invention, the locking element can furthermore be designed to close the receiver in a blocking position/locking position, i.e. when the anti-rotation stop engages and is thus effective, so that no contamination can enter into said receiver and into the interior space of the dispensing device. For this purpose, the locking element covers the outlet opening of the receiver in the blocking position. In terms of design this can be solved, for example, in that the receiver is arranged on the front face of the dispensing device according to the invention, so that its outlet opening is aligned in a radial direction to the dispensing device and that the locking element is arranged along a surface line outside on the dispensing device according to the invention and can be moved across the outlet opening.

The locking element can be pivoted to the segregating device or be mounted in a longitudinal guide on the segregating device. In order to realize a locking position, the locking element can be developed by a locking pawl, which can engage on the singularizing device by a transitory or swivel motion, in particular parallel to the axis of rotation of the singularizing device, in a corresponding penetration/a corresponding cutout/notch, preferably a locking groove. These openings/cutouts/notches/slots for example can be introduced in a rim of the singularizing device protruding radially outward or inward for example, specifically preferably at equal spacing between each other, particularly preferably in each case at the same angular distance, which is also occupied by the chambers of the singularizing device between each other. The openings and suchlike are formed between projections.

Furthermore it can preferably be provided that the anti-rotation stop for the twisting of the singularizing device vis-à-vis the segregating device is to be translated into a pre-loaded position and in an unloaded position locks the two components against twisting. For this purpose, a tensioning element, in particular a spring element, for example a compression spring or spiral tension spring for a leaf spring, can produce the pretension. The tensioning element can translate or swivel the sliding element or an unlocking probe into the blocking position. In the blocking position, the locking element can preferably also cover the outlet opening of the external receiving device. The tensioning element can be used as reset element.

If the receiver is open to the bottom, it must further be ensured that any solid portions entering into it must initially be retained there before a user can remove them collectively. A portion barrier is provided for this purpose, which shuts off the cavity of the receiver to the bottom. This portion barrier can be designed as finger-like element that closes the cavity to the bottom. This barrier element is preferably actuated with the locking element. The locking element can be developed as actuation switch for example and include this portion barrier as additional component, so that the barrier of the cavity is set during actuation. As a result, singularized, segregated solid portions that have reached the receiver are retained in the receiver. This barrier is canceled only when the locking element is no longer actuated, so that the solid portions can drop out of the cavity. To lock the cavity to the bottom, in an alternative embodiment it can also be provided that the receiver is movable or pivotable, so that the cavity is closed by a component of the dispensing device in a first slide/swivel position, for example by the partition wall of the segregating device, and is open in a second slide/swivel position. The preferred embodiment for a pivotable receiver is described previously.

In a further preferred refinement of the present invention, the components of the dispensing device are designed to be reciprocally rotatable exclusively in one direction of rotation, i.e. in a singularizing and dispensing direction. For this purpose, a ratchet track can be provided on an outer surface of the singularizing device, which ratchet track engages in at least one latch element that can be latched with the ratchet track on the receiving device or on another component, such as the segregating device. This latch element can also be developed in form of a ratchet. The ratchet track and optionally the ratchet are developed by corresponding shaping of ratchet teeth to permit a rotation only in one direction of rotation.

The ratchet track and the at least one ratchet element can further be developed to permit a rotation of the singularizing device vis-à-vis the segregating device in separate steps by respectively that fixed angular value, in which also the singularizing and transfer of individual solid portions or a specific fixed number of multiple solid portions occurs in the receiver. For this purpose, the angular distance of the ratchet teeth corresponds either to the angular distance between two subsequent chambers in the motion path in the singularizing device, or to a multiple of this angular distance or a part of this angular distance.

In a further preferred refinement of the present invention the segregating device has an observation window, so that the solid portions contained in the chambers, in particular the solid portions lifted out of the bulk body, are visible from outside. Alternatively, the entire outer casing of the dispensing device or at least an essential part thereof are made of a transparent material.

In a further preferred refinement of the present invention, the dispensing device further has a device for adjustable limitation of the twisting of the singularizing device vis-à-vis the segregating device, in order to be able to preset the number of solid portions to be dispensed. An adjustable ring is provided on the segregating device for example, which ring forms a stop for a stop element present on the singularizing device. The adjustable ring preferably engages at fixed positions, which correspond to a number of solid portions to be preselected.

In a further preferred refinement of the present invention, the dispensing device is connected to a storage container for the solid portions. A tamper-proof closure is furthermore attached on the storage container. The tamper-proof closure serves to ensure and provide visible proof that the dispensing entirety, i.e. the dispensing device according to the invention and the storage tank, were not used or opened prematurely, i.e. prior to a first use by a user. For this purpose, the tamper-proof closure is held on the container with a positive joint, by holding the dispensing device on its part, in that the tamper-proof closure for example prevents that the dispensing device can be removed from the storage container, for example be unscrewed from its discharge spout. The tamper-proof closure can be developed in form of a ring, for example. The positive engagement between the tamper-proof closure and the storage container can be formed by a protruding edge on the discharge spout of the storage container and by upright first latch fingers on the tamper-proof closure, for example. For assembly, the tamper-proof closure is fitted onto the storage container so that it snaps behind the edge on the container spout. The tamper-proof enclosure further has latch elements, for example second latch fingers pointing inward, which interact with the retaining elements on the dispensing device according to the invention, for example on the singularizing device, by means of a positive joint. These retaining elements on the dispensing device can be formed by a ratchet collar, for example. After fitting the tamper-proof closure onto the storage container, the dispensing device can be screwed onto the container until the second latch fingers engage in the ratchet collar. As soon as the dispensing device is connected to the storage container with a positive joint, the dispensing device can no longer be removed from the storage container without damaging the tamper-proof closure. The tamper-proof closure also ensures that the dispensing device according to the invention cannot be screwed too far onto the storage tank, so that the separating device or another component element on the inside does not sever the sealing foil when said dispensing device is screwed-on. For the use of the dispensing device on the storage container, the tamper-proof closure is removed from the storage container, in that said closure is severed on a predetermined breaking point, for example. In this way, the dispensing device can be tightly screwed onto the storage container.

BRIEF DESCRIPTION OF THE DRAWING FIGURES

Figure 2:
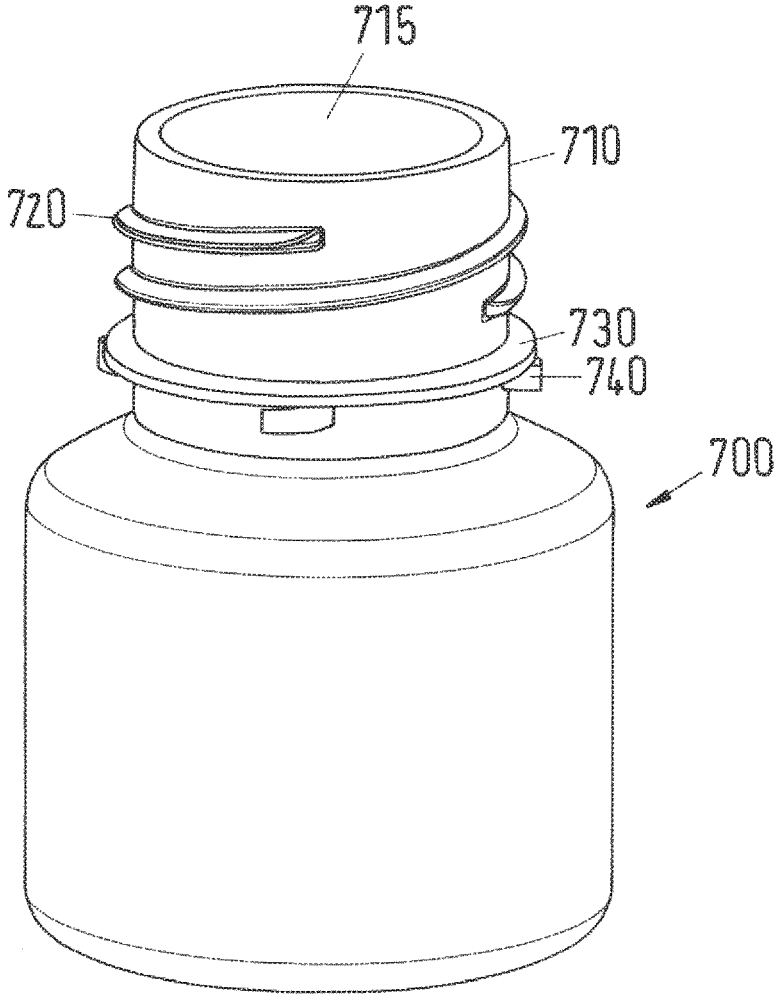
Figure 3A:
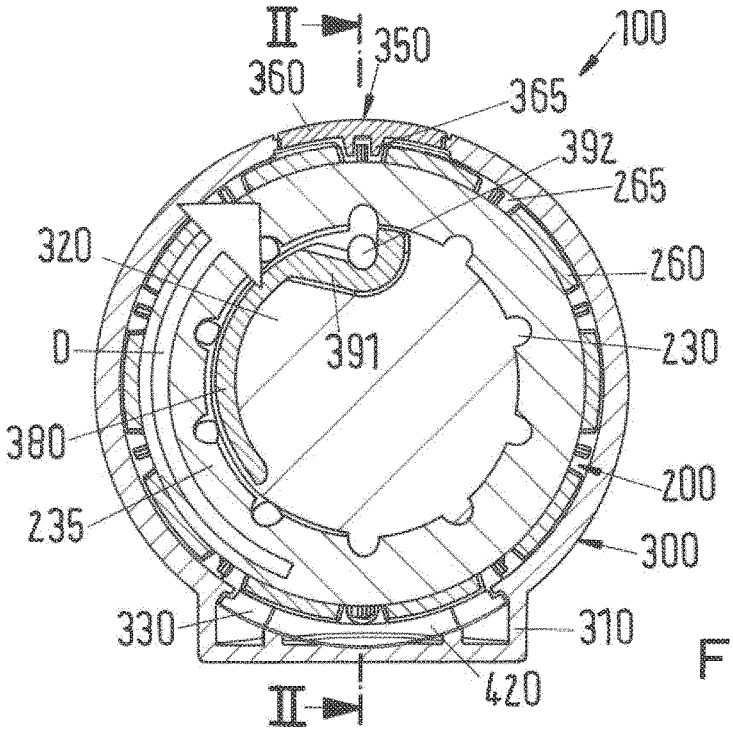
Figure 3B:
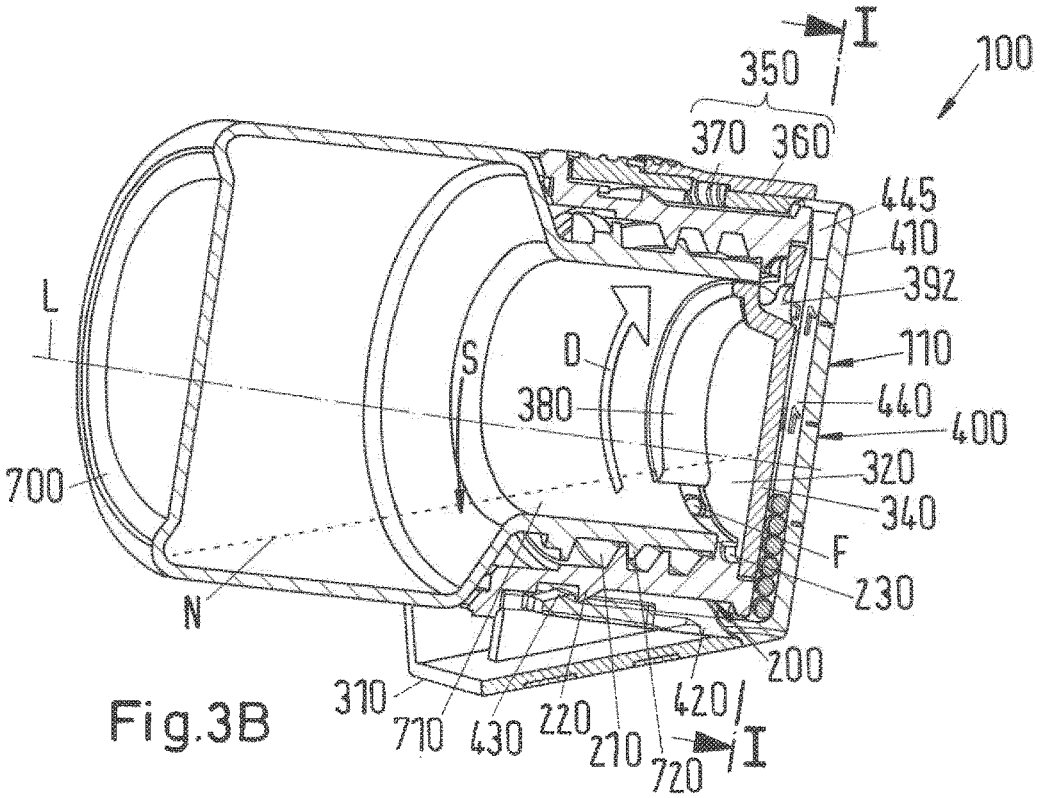
Figure 4:
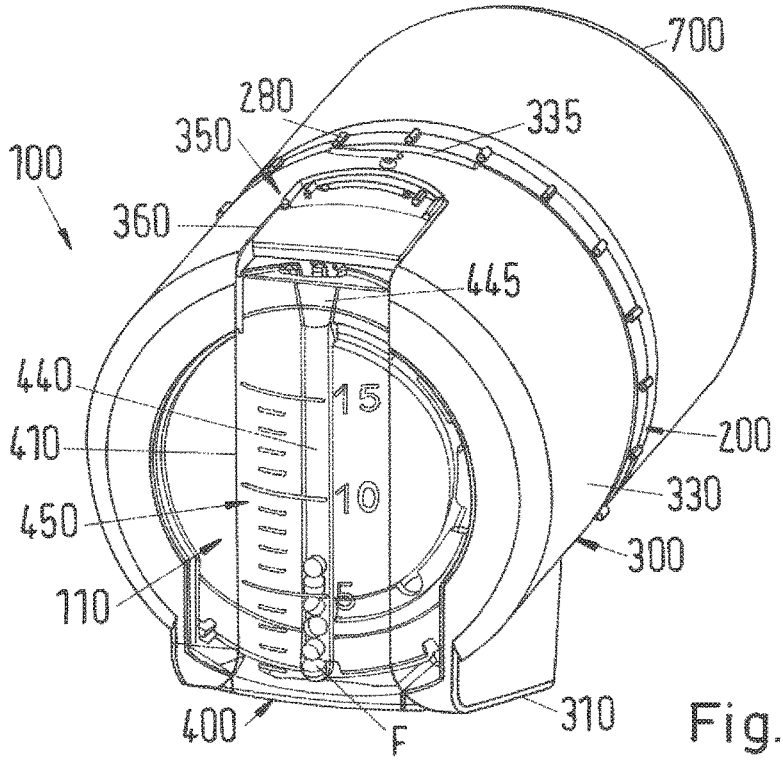
Figure 5:
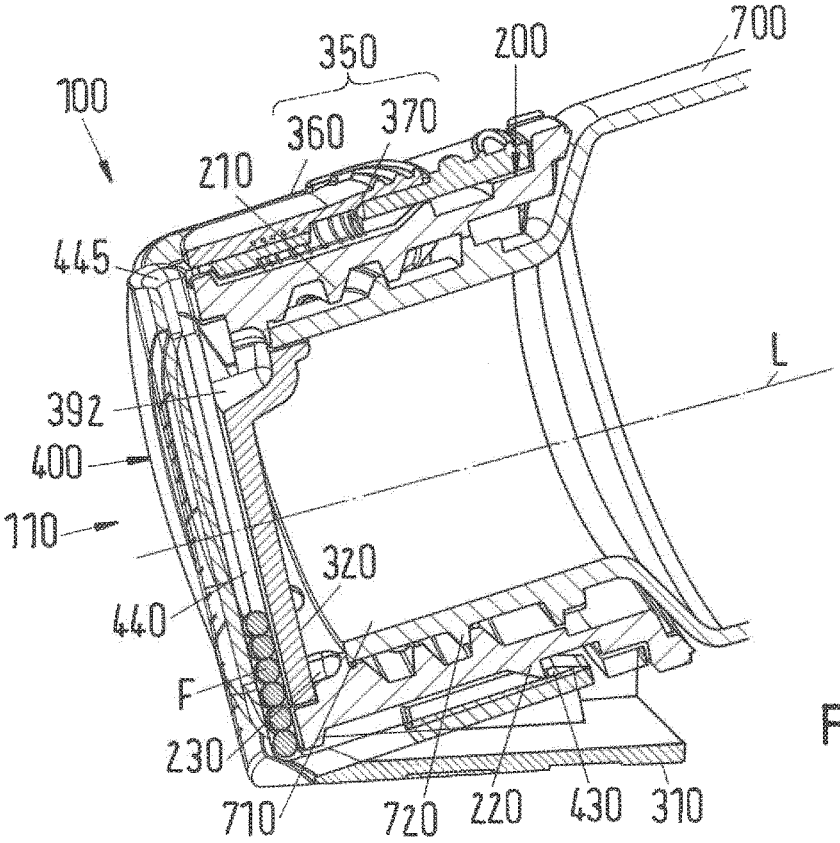
Figure 10:
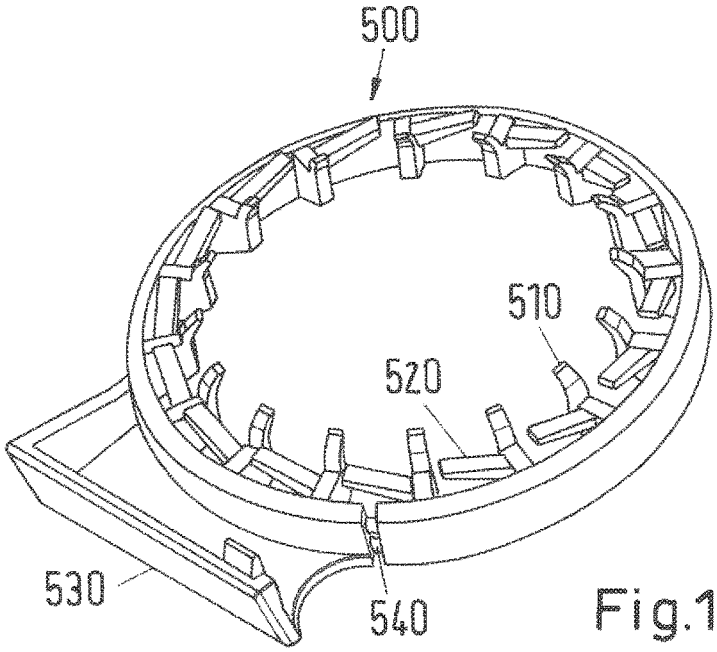
Figure 11:
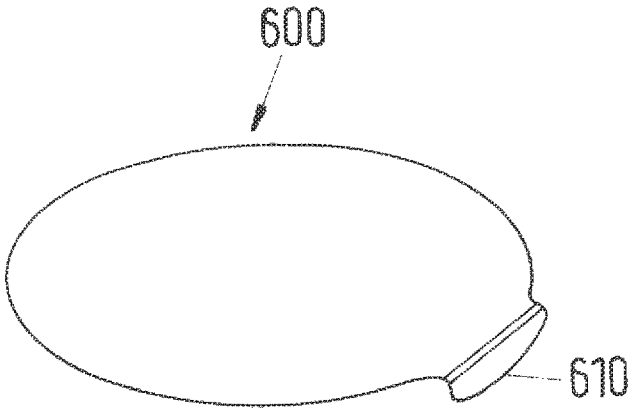

The present invention is subsequently explained in detail by reference to the figures. These serve merely for illustration and are therefore to be understood exclusively as examples, which show the following details:

FIG. 1: exploded view of the dispensing device according to the invention in a first embodiment;

FIG. 2: perspective representation of a storage container provided for connection to the dispensing device according to the invention;

FIG. 3: representations of the dispensing device according to the invention in the first embodiment; (A) in a cross-sectional view along section I-I of FIG. 3B perpendicular to a longitudinal or rotational axis of the dispensing device; (B) in an isometric representation in a longitudinal section II-II of FIG. 3A;

FIG. 4: isometric representation of the dispensing device according to the invention in the first embodiment, which is connected to a storage container, viewed from the front face, on which is the connecting device;

FIG. 5: isometric representation of the dispensing device according to the invention in the first embodiment in a longitudinal section; representation of the sliding element provided for blocking the twisting of the singularizing device vis-à-vis the segregating device;

FIG. 6: isometric representations of the singularizing device of the dispensing device according to the invention in the first embodiment; (A) in an oblique view onto the front face; (B) in an oblique view onto the screw-in side;

FIG. 7: isometric representations of the segregating device of the dispensing device according to the invention in the first embodiment; (A) in an oblique view onto the front face; (B) in an oblique view onto the screw-in side;

FIG. 8: isometric representations of the receiving device of the dispensing device according to the invention in the first embodiment; (A) in an oblique view onto the front face; (B) in an oblique view onto the opposite side;

FIG. 9: isometric representations of the sliding element of the dispensing device according to the invention in the first embodiment; (A) in an oblique view onto the upper side; (B) in an oblique view onto the underside;

FIG. 10: isometric representation of the tamper-proof closure;

FIG. 11: isometric representation of the sealing foil.

Figure 12:
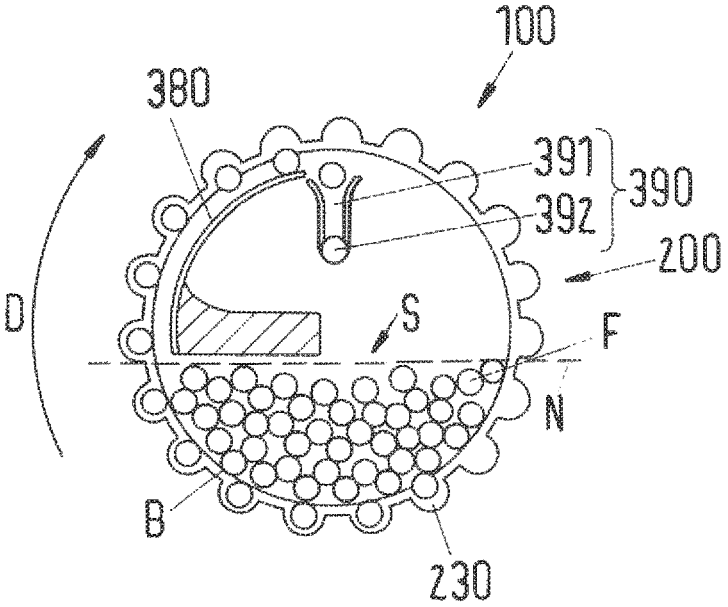
Figure 14:
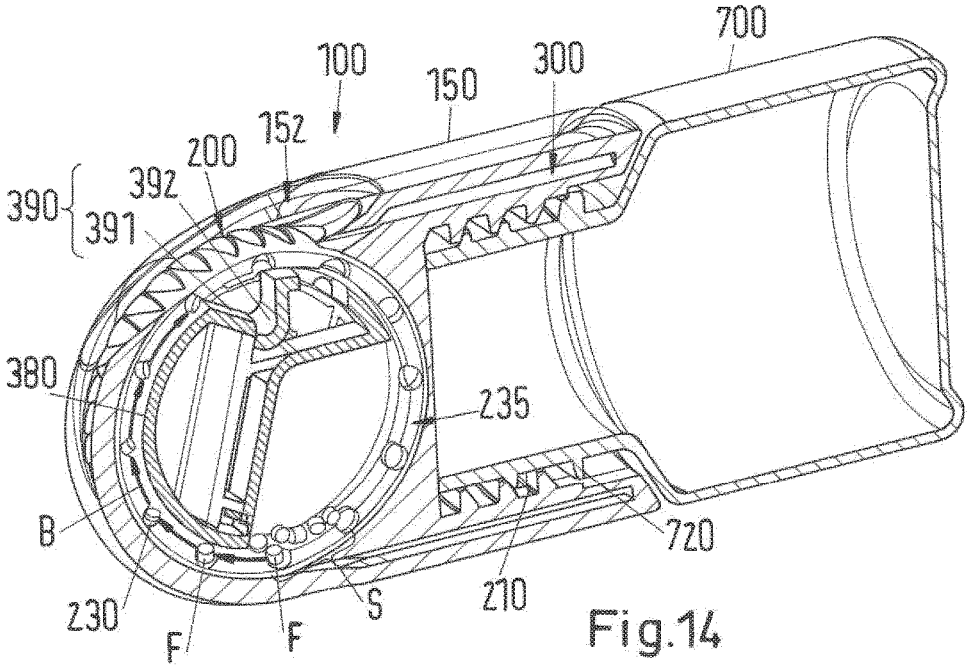
Figure 15A:
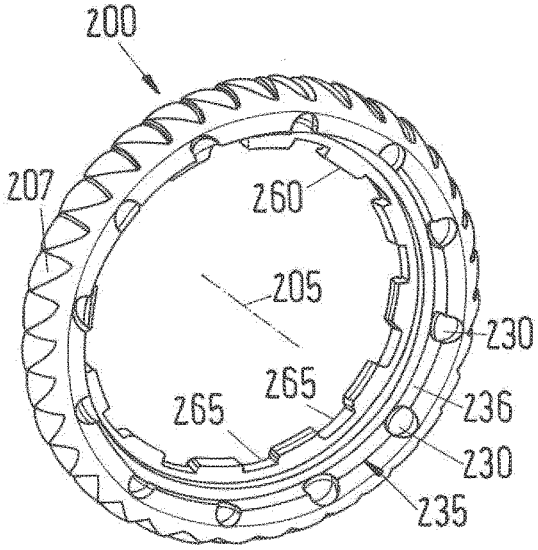
Figure 15B:
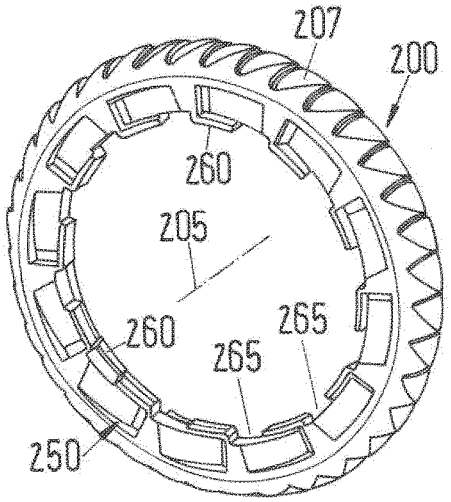
Figure 22A:
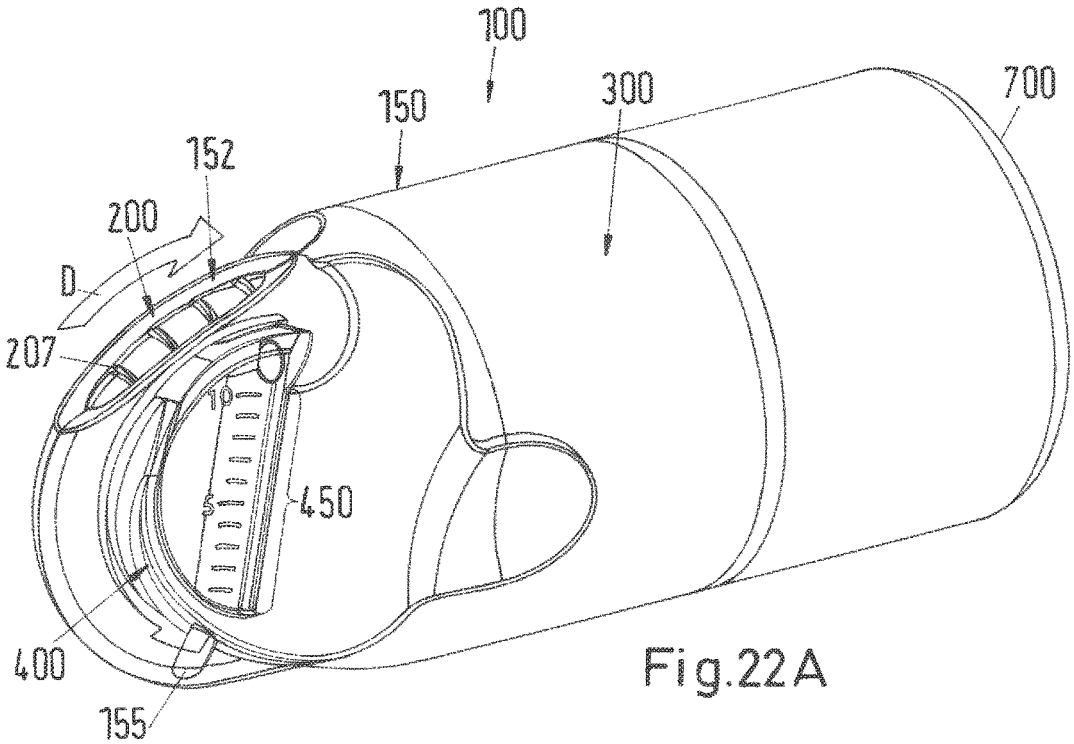
Figure 22B:
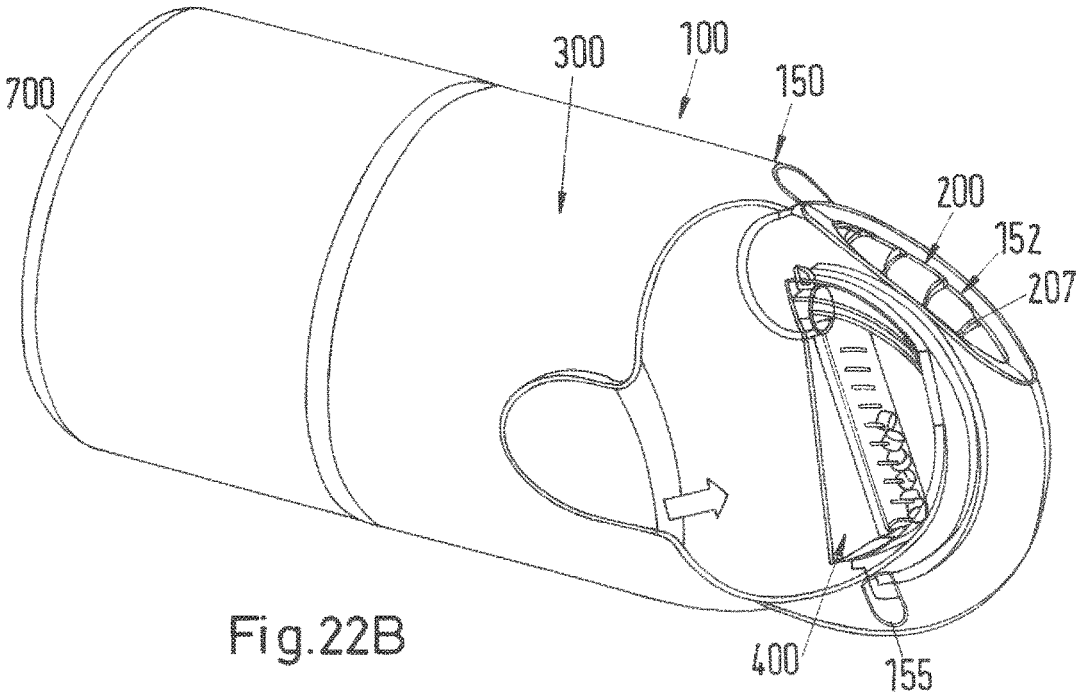
Figure 23B:
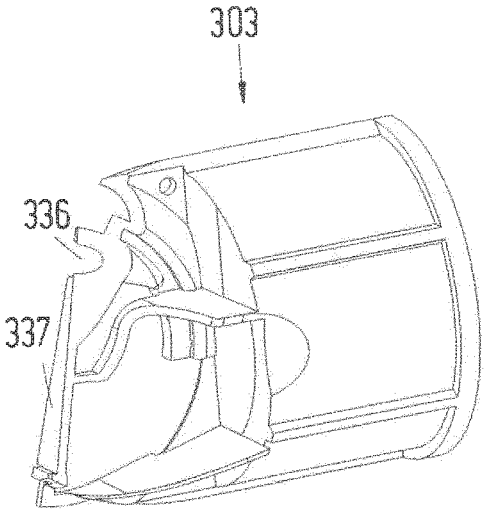
Figure 23B:
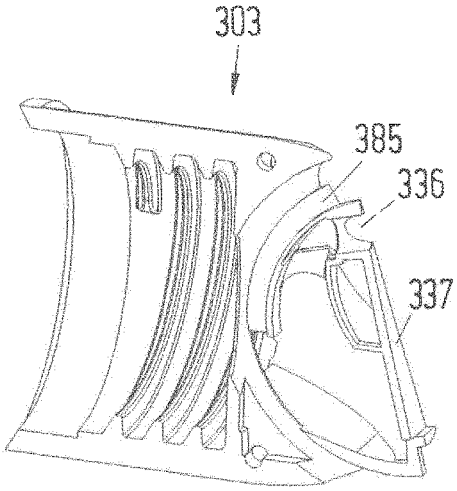
Figure 24A:
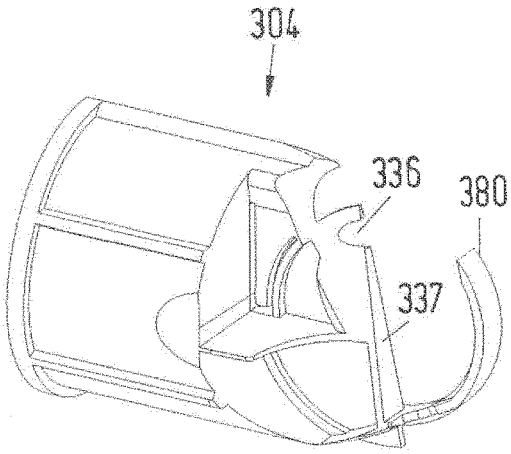
Figure 26:
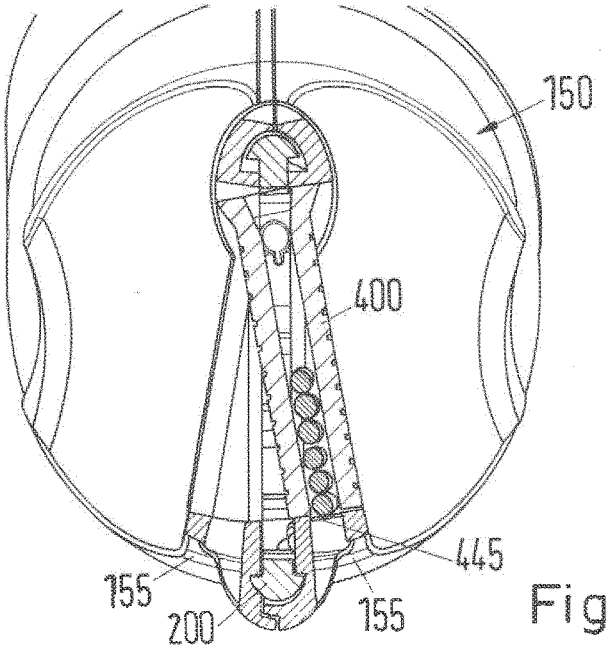
Figure 27A:
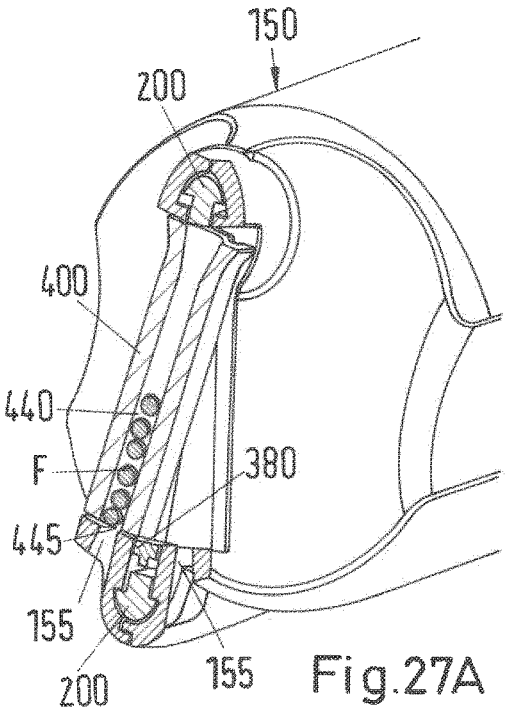
Figure 27B:
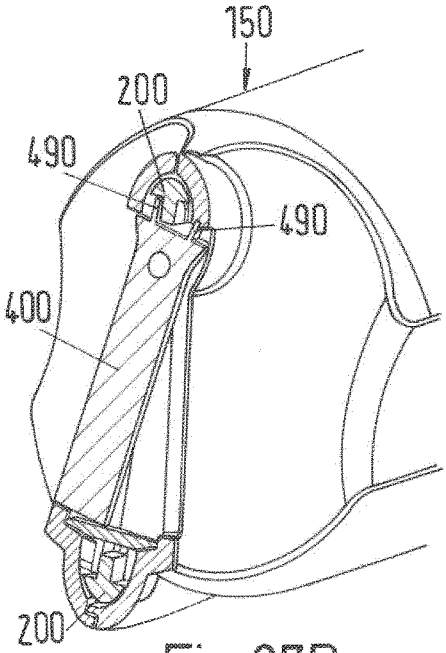
Figure 28A:
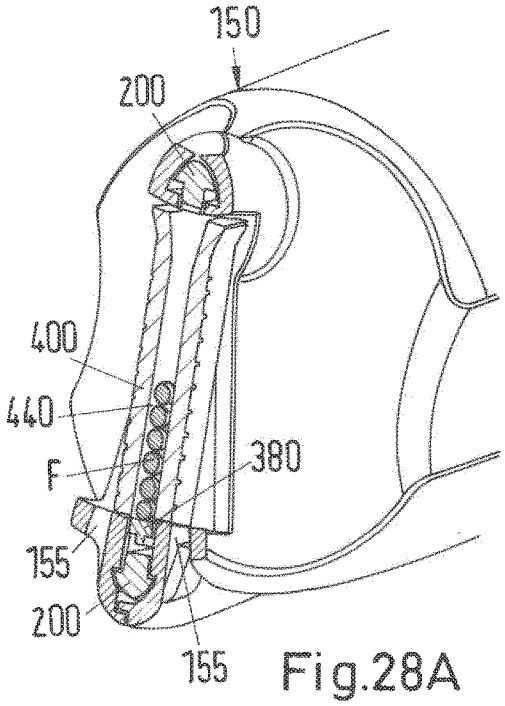
Figure 29A:
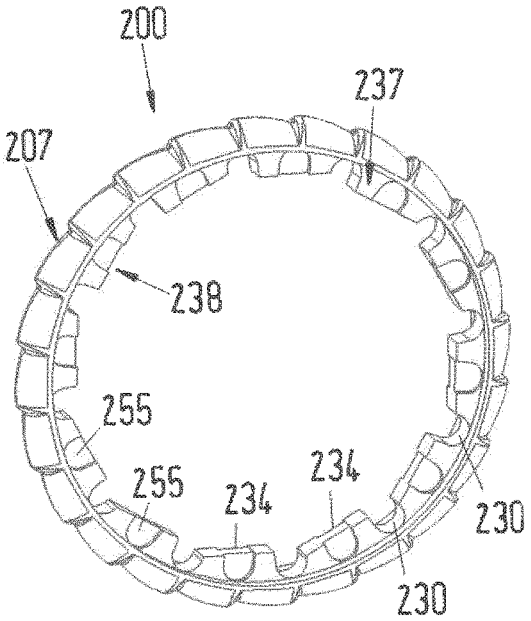
Figure 29B:
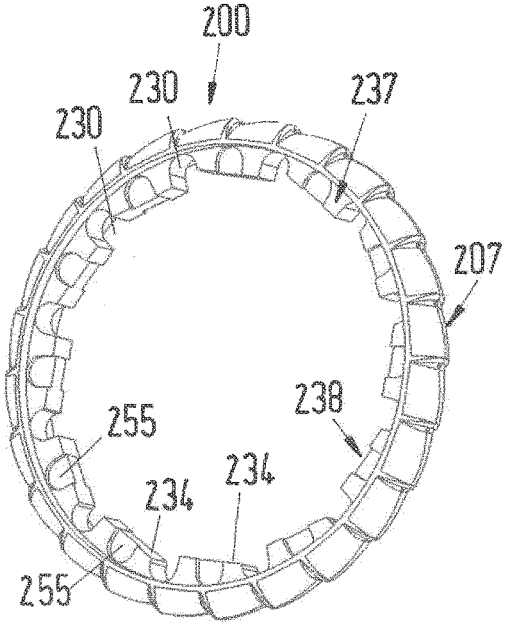
Figure 30:
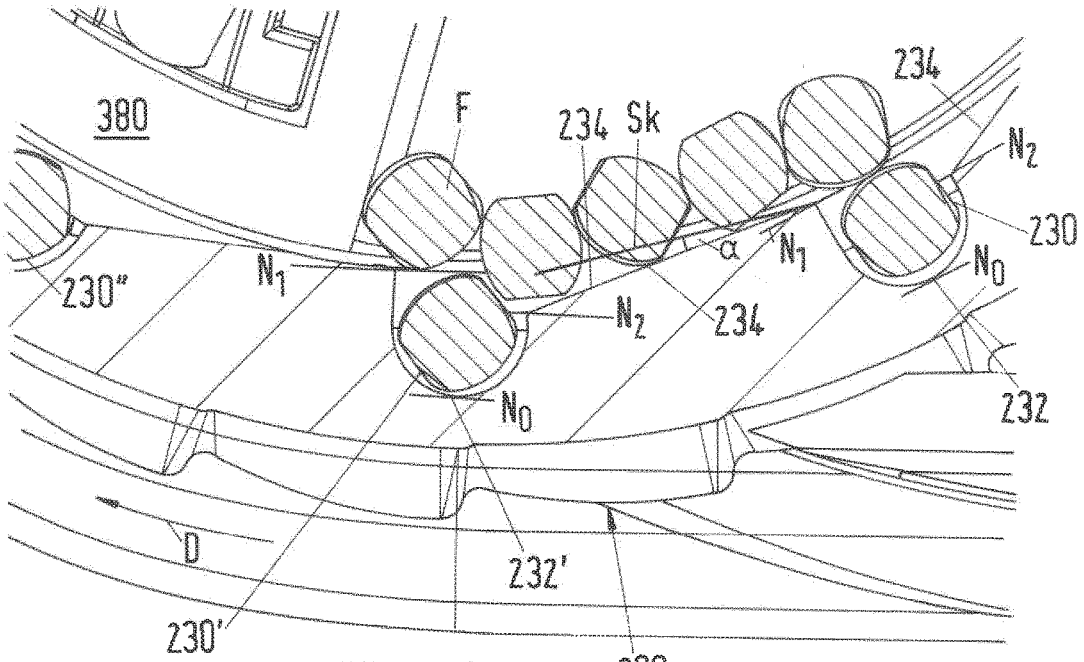

FIG. 12: schematic diagram of the invention in a schematic cross-section through a dispensing device according to the invention (view as in FIG. 3A);

FIG. 13: isometric representations of the dispensing device according to the invention in a first variant of a second embodiment with a tablet bottle in horizontal position connected therewith for removal of solid portions; (A) oblique view of right front; (B) oblique view of left front;

FIG. 14: cutaway isometric representation of the dispensing device according to the invention in the first variant of the second embodiment with connected tablet bottle in horizontal position for removal of solid portions;

FIG. 15: isometric representation of the singularizing wheel of the dispensing device according to the invention in the first variant of the second embodiment; (A) view of the side of the chambers; (B) view of the side of the ratchet track;

FIG. 16: isometric representations of a first half-shell element of the segregating device of the dispensing device according to the invention in the first variant of the second embodiment; (A) oblique view of right front; (B) oblique view of left front;

FIG. 17: isometric representations of a second half-shell element of the segregating device of the dispensing device according to the invention in the first variant of the second embodiment; (A) oblique view of left front; (B) oblique view of right front;

FIG. 18: isometric representations of the housing outer skin (shell) of the dispensing device according to the invention in the first variant of the second embodiment; (A) oblique view of right front; (B) oblique view of right rear (from the screw-in side);

FIG. 19: isometric representations of the unlocking probe of the dispensing device according to the invention in the first variant of the second embodiment; (A) oblique view of left front (outer side); (B) oblique view of right front (interior side);

FIG. 20: cutaway isometric representations of the dispensing device according to the invention in the first variant of the second embodiment in the locked state: (A) section at elevation of the portion barrier; (B) section at elevation of the locking element;

FIG. 21: cutaway isometric representations of the dispensing device according to the invention in the first variant of the second embodiment in the actuated (unlocked) state; (A) section at elevation of the portion barrier; (B) section at elevation of the locking element;

FIG. 22: isometric representations of the dispensing device according to the invention in a second variant of the second embodiment with a tablet bottle in horizontal position connected therewith for removal of solid portions; (A) oblique view of right front, receiving device in the central swivel position; (B) oblique view of left front, receiving device in the right lateral swivel position;

FIG. 23: isometric representations of a first half-shell element of the segregating device of the dispensing device according to the invention in the second variant of the second embodiment; (A) oblique view of right front; (B) oblique view of left front;

FIG. 24: isometric representations of a second half-shall element of the segregating device of the dispensing device according to the invention in the second variant of the second embodiment; (A) oblique view of left front; (B) oblique view of right front;

FIG. 25: isometric representations of a receiver in the second variant of the second embodiment; (A) oblique view of right front; (B) oblique view of left rear as section;

FIG. 26: cutaway isometric representation of the dispensing device according to the invention in the second variant of the second embodiment in the locked state; design for left-handed and right-handed persons, during use by a right-handed person;

FIG. 27: cutaway isometric representations of the dispensing device according to the invention in the second variant of the second embodiment in the locked state; design for left-handed and right-handed persons, during use by a left-handed person; (A) section at the elevation of the tablet barrier; (B) section at the elevation of the locking mechanism;

FIG. 28: cutaway isometric representations of the dispensing device according to the invention in the second variant of the second embodiment during singularizing of the solid portions; design for left-handed and right-handed persons; (A) section at the elevation of the tablet barrier; (B) section at the elevation of the locking device;

FIG. 29: isometric representations of the singularizing wheel of the dispensing device according to the invention in the second variant of the second embodiment; (A) lateral view of right; (B) lateral view of left;

FIG. 30: detailed view of a singularizing wheel with ramps extending inclined between the chambers from the side.

DETAILED DESCRIPTION OF THE INVENTION

In the figures subsequently described, elements designated with the same reference symbols are identical elements or elements with the same function.

Figure 13A:
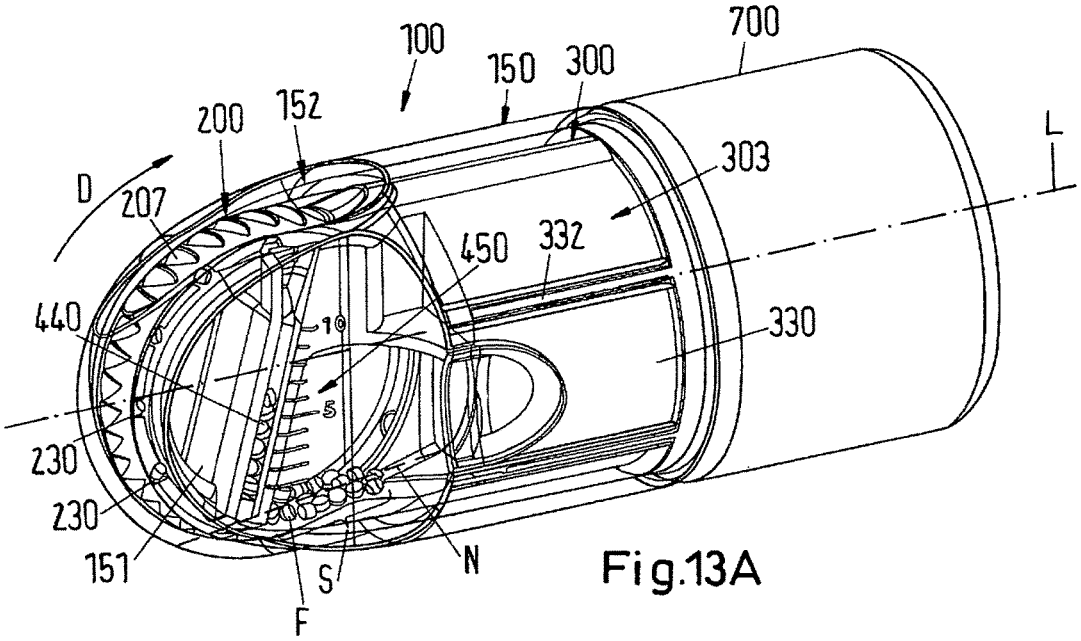

A schematic diagram for explanation of the functionality of the dispensing device 100 according to the invention is shown in FIG. 12:

For the application of the dispensing device 100 according to the invention, it is tilted with an attached storage container 700 from the upright into a horizontal position (position of use), so that the longitudinal axes L of the device and of the container extend slightly tilted to the horizontal (see for example FIG. 3B, 13A). For this purpose, the dispensing device according to the invention is deposited onto a base together with the storage container for example with the supporting surface of an apron 310 on the segregating device 300 (FIG. 3B, first embodiment), or the user holds the dispensing device with one hand in the horizontal position (FIG. 13A, second embodiment). Because of the tilt, the bulk body S of the solid portions F within the storage container reaches the dispensing device, wherein the bulk body fills the dispensing device in longitudinal direction up to a level N. Because of the slight tilt, the solid portions can preferably reach the chambers 230. The bulk body accumulates there. This applies accordingly in the case that the dispensing device for its use would not be connected to a storage container. In this case, during tilting the solid portions would spread in the interior space of the dispensing device in the aforementioned manner.

For singularizing the solid portions F out of this bulk body S, the singularizing device 200 and thus the chambers 230 formed therein are rotated in the direction of rotation D shown in FIG. 12. By the rotation of the singularizing device, the chambers are rotated on a circular motion path B in a plane perpendicular (first embodiment) or parallel (second embodiment) or in yet another direction to a longitudinal axis L of the dispensing device 100. In that context in the position of use the lower chambers traverse the bulk body of the solid portions and in each case pick up one of these portions, since their size and form matches the solid portions. During the rotation, the chambers filled in this way are then lifted out of the bulk body in the direction of rotation and consequently also bring out the solid portions contained in said chambers from the bulk body. So that the solid portions do not drop out again from the chambers during this rotation, the chambers are closed by a separating device in form of a partition wall 380 if they are on their motion path above the bulk body. This partition wall does not twist together with the rotation of the singularizing device, but is held torsion-proof vis-à-vis the singularizing device. Once a chamber with a solid portion contained therein has approximately reached the uppermost position, the solid portion arrives at a transfer path 390 expanded in the form of a cone, onto which transfer path the solid portion can arrive at its no longer closed chamber, in that it drops out of its chamber, specifically initially into the funnel section 391 or onto a ramp or suchlike and subsequently into the feedthrough duct 392 of the transfer path. From this point in the interior area of the singularizing device, the feedthrough duct leads out from the interior area and therefore guides the solid portion into a receiver 440 (FIG. 3B or FIG. 13A). For each solid portion to be filled into the receiver, the singularizing device must be rotated further by one step. By means of a dosing scale 450, the user can easily read off the number of the solid portions that have already reached the receiver.

The dispensing device 100 is developed as a hollow body, which can be open on one side, in order to securely couple the device to a storage container 700, for example a tablet bottle (FIG. 3B or FIG. 13A). The storage container has typically one discharge spout 710, through which the solid portions F, for example tablets and particularly preferably mini and micro-tablets or globules, can be emptied from the container so that a user can ingest these portions (FIG. 1, 2).

The discharge spout is generally provided with an external thread 720, which serves for screwing the closure onto the discharge spout (not illustrated). In the present case, this thread can be used to connect the dispensing device to the discharge spout. For this purpose, the dispensing device must be provided with an internal thread 210, which is complementary to the external thread of the storage container (FIG. 3B or FIG. 14). The dispensing device can be available for a user either as a separate device, so that said user can screw the device onto the discharge spout of the container if needed, i.e. if a new primary package (storage container) is to be opened. Or the dispensing device is supplied to the user together with the container, wherein the dispensing device with its open end on the one side is already screwed onto the discharge spout of the container, for example. In yet a further variant for implementation and use of the dispensing device according to the invention, said dispensing device does not have an open end but is closed on all sides and thereby forms a storage space for the solid portions. In this case, the solid portions are transferred from the storage container into the interior space of the hollow body, as required.

FIG. 1 illustrates the essential components of the dispensing device 100 according to the invention in a first embodiment in an exploded view. The dispensing device is formed essentially by a singularizing device 200 and a segregating device 300 with an anti-rotation stop 350. In addition, it has a receiving device 400. For securing the dispensing device on the storage container 700, a tamper-proof closure 500 is further provided. To connect the segregating device, it is placed over the singularizing device. The front face of the receiving device connects to the segregating device. The anti-rotation stop is formed by a locking element in form of a sliding element 360, for example by a locking knob, and a tensioning element 370, for example a resetting spring. The tamper-proof closure is fitted onto the discharge spout 710 of the storage container, where it is held by means of a positive joint. A sealing foil 600 serves for sealing the discharge opening, so that the interior space of the storage container is protected. FIG. 3B illustrates the above listed components of the dispensing device according to the invention in the assembled state.

Figure 8A:
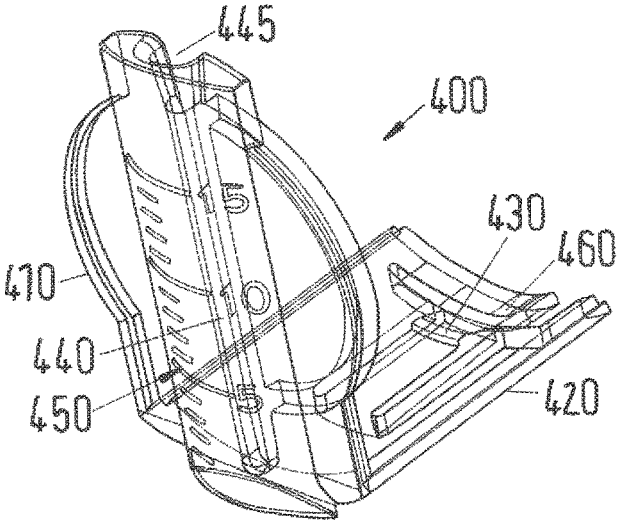
Figure 8B:
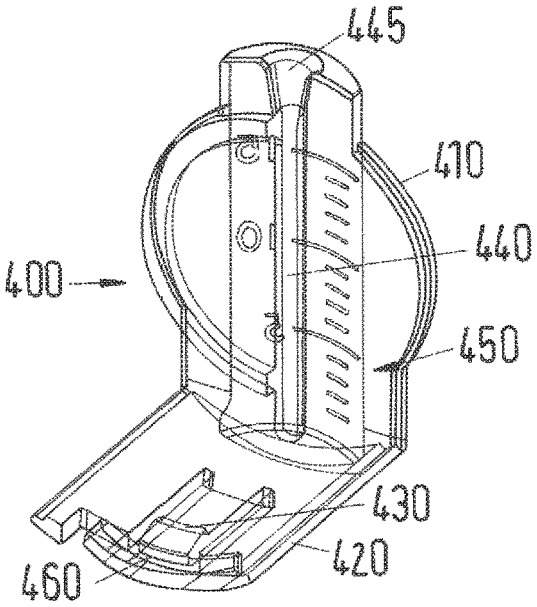

The receiving device 400 is formed by a frontal leg 410 and an axial leg 420, which are connected to one other as one piece at a right angle (FIG. 8A, 8B). In the assembled state, the frontal leg abuts against the front face 110 of the dispensing device 100. The axial leg reaches under the segregating device 300 in the area of a bulging apron 310 and can therefore abut against the outside of the singularizing device 200. The segregating device and the singularizing device are formed by partially axisymmetrical hollow bodies, which are inserted into one another. For this purpose, the segregating device almost completely reaches over the singularizing device. In the area of its end, the axial part 420 of the receiving device is equipped with an inward facing snap hook 430. During the assembly of the aforementioned three components, said snap hook engages on the outside of the singularizing device by means of a snap ring 220 (FIG. 3B, 5, 6A, 8B). As a result, the receiving device and the singularizing device are connected to one another, wherein the engagement of the receiving device with the singularizing device permits the singularizing device to twist vis-à-vis the receiving device because of the circumferential snap ring. Because of this engagement, the segregating device is held between the receiving device and the singularizing device.

The singularizing device 200 has on its inner side, that is on the ring area facing away from front face 110 of the dispensing device 100, the screw thread 210, which serves to establish a screw connection with the screw thread 720 on the discharge spout 710 of the storage container 700 (FIG. 3B, 5, 6A, 6B). The unit consisting of the singularizing device, the segregating device and the receiving device 400, can thus be screwed onto the discharge spout of the storage container. The singularizing device is securely connected to the storage container in the screwed-on state. As a result, this unit can be twisted vis-à-vis the receiving device and the segregating device.

Figure 6A:
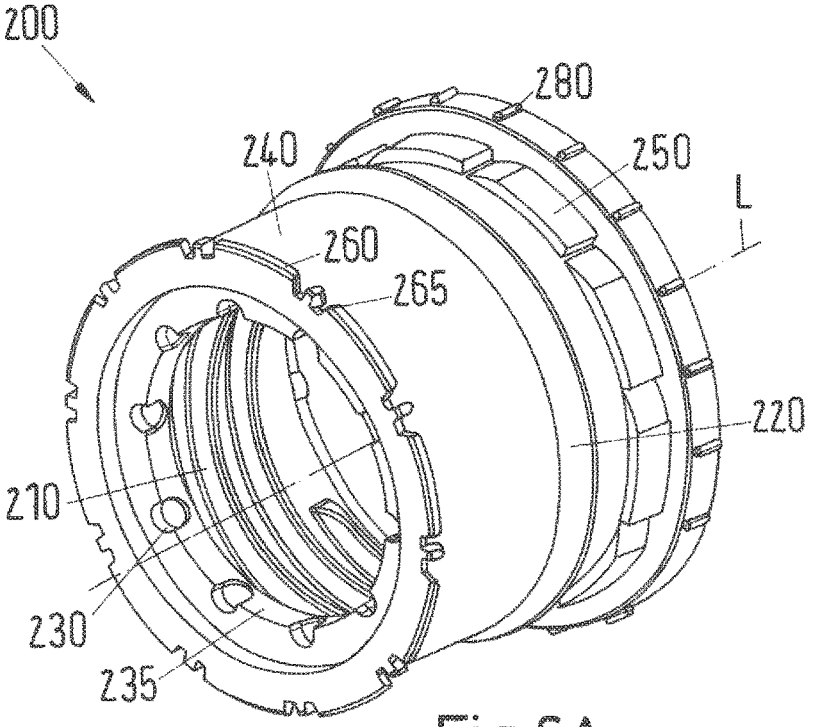

The singularizing device 200 is formed by a body of revolution with an axisymmetrical casing 240, which has recesses on the edge region for forming the chambers 230, which abut on the segregating device 300 in the assembled state (FIG. 3A, 6A). These recesses are cutouts in an annular inner shoulder 235 on the inner circumference of the singularizing device. In the assembled state, a front inner surface 320 of the segregating device abuts flush against this shoulder (FIG. 3B, 5), so that these cutouts/recesses 230 are closed towards this side and are still open only in radial direction to the interior space of the singularizing device. The chambers 230 formed as a result along the inner side of the singularizing device are disposed at equal spacing between one another. In the present case, 10 chambers are formed along the periphery, the angular distance of said chambers being respectively 36° to a longitudinal axis L of the singularizing device. The chambers form oval cavities matching the form of the solid portions F to be accommodated, for example mini and micro tablets or globules. They moreover are sufficiently sized to accommodate the mini or micro tablets or globules.

The segregating device 300 (FIG. 7A, 7B) is developed essentially pot-shaped and therefore has a partially axisymmetrical casing 330 and a frontal cap 340. In the assembled state the segregating device is placed with its casing over the singularizing device and then abuts with its cap against the annular inner shoulder 235 of the singularizing device 200, in which the cutouts are formed for the chambers 230. Because of the apron 310 that protrudes outward, there is a break in the axisymmetrical part of the casing of the segregating device, which apron also forms a part of the casing. On the one hand, this apron serves to accommodate the axial leg 420 of the receiving device 400, so that said leg reaches under the apron and can abut on the outside of the singularizing device. On the other, the apron also forms a supporting surface for placing and supporting the dispensing device 100 onto a solid base (confirmation position). The supporting surface of the apron is inclined vis-à-vis the longitudinal axis L of the dispensing device, that is towards its front face 110, so that the dispensing device is resting tilted forward when supported on this apron. As a result, the solid portions F can collect in a bulk body S in the frontal part of the dispensing device when the dispensing device with the apron is deposited onto the solid base. In FIG. 3B, this is schematically indicated by the upper level of the bulk body N, which level runs parallel to the supporting surface of the apron.

Figure 7A:
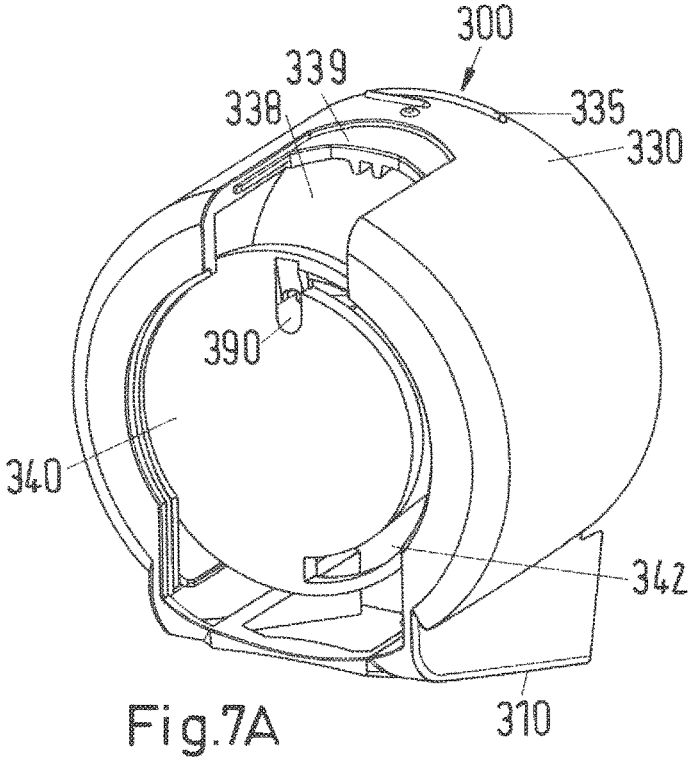
Figure 7B:
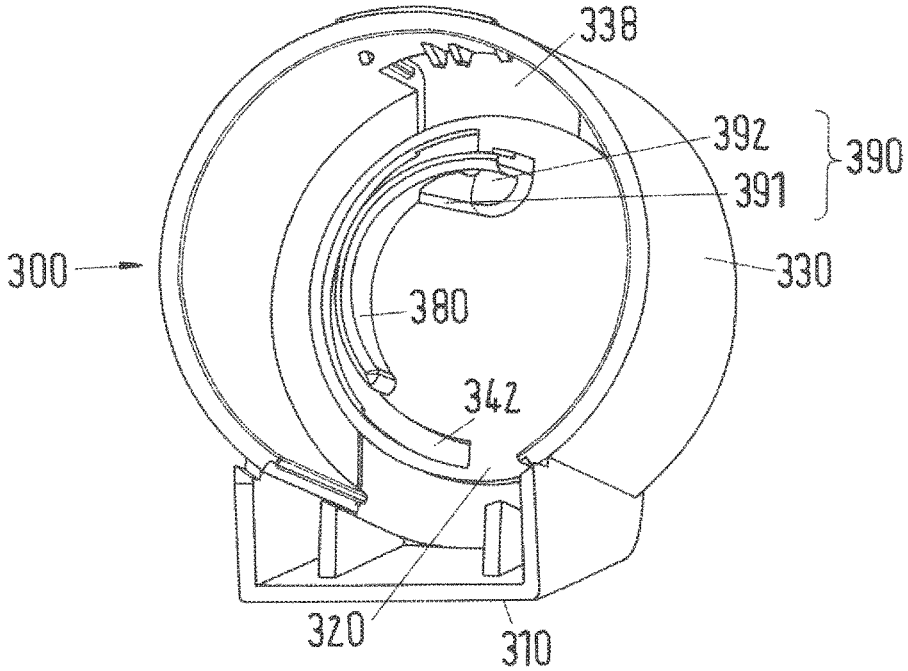

A part of the segregating device 300 that is essential to the invention is a separating device in form of a partition wall 380 protruding inward at a right angle from the front wall 340 of this device, which partition wall extends into the interior space of the dispensing device 100 in the assembled state (FIG. 3B, 7B). This partition wall extends along a circular curved path directly adjacent and parallel to the annular inner shoulder 235 of the singularizing device 200, in which the chambers 230 are located. This partition wall extends only across one circular segment, which (when the segregating device rests on the base by means of the apron, configuration as in FIG. 3B, 7B) starts above the lowest point of the circular trajectory of the chambers and terminates below the highest point. The width of the partition wall is selected such that it can cover the chambers completely.

In the upper end section, the partition wall 380 merges into a transfer path 390, which continues (funnel section 391) from the partition wall initially kinking clockwise to the rotational axis (FIG. 7B) and then kinking in the axial direction leads out of the segregating device 300 through the frontal cap 340 (feedthrough duct 392; FIG. 3B, 7A, 7B). The part of the transfer path connecting to the partition wall can initially have a larger cross-section for accommodating the solid portions F than the subsequent part, to ensure that the solid portions are securely received during the transfer from the chambers 230 into the transfer path.

The axial part 392 of the transfer path 390 terminates in the dosing tube 440 in the receiving device 400 (FIG. 3B, 4, 5). In one configuration of the dispensing device according to the invention as in FIG. 3B, 4, 5, 7B (position of use), the dosing tube runs slightly inclined to the vertical, so that the solid portions F that have reached the transfer path, subsequently drop into the lower part of the dosing tube. To ensure that the dropped solid portions are retained in the dosing tube, same is closed to the bottom. In the example shown in FIG. 4, 5, six solid portions have dropped into the dosing tube and are lying there stacked on top of each other. This is indicated by the dosing scale 450 which is for example impressed or embossed or printed and which is attached to the outside of the receiving device, so that a user can recognize at a glance how many solid portions were already released (dosing quantity). For the removal of the solid portions that have entered the dosing tube, the dosing tube is open to the top (discharge opening for 445). For removing the solid portions, the dispensing device can be turned around (release position), so that the solid portions within the dosing tube drop out. The discharge opening is expanded to the outside in the form of a cone.

The frontal cap 340 of the segregating device 300 further has an observation windows 342, which extends approximately along a circular trajectory coaxially to longitudinal axis L of the dispensing device 100 (FIG. 7A), wherein also the partition wall 380 extends parallel to the observation window and along a motion path B of the chambers 230 generated by the rotation of the singularizing device 200 (FIG. 7B, 12), so that the solid portions F in the chambers can be monitored visually from outside. For this purpose, the observation window is made of transparent material.

The axial part 420 of the receiving device 400 engages behind the apron 310 of the segregating device 300 and by means of its snap hook 430 engages with the snap ring 220 of the singularizing device 200. For this purpose, the axial part lies in a recess of the axisymmetrical part 330 of the segregating device 300 and with its flanks abuts on those of the axisymmetrical part 330 and in this manner forms a supplement of this axisymmetrical casing (FIG. 3A). As a result, the axial part of the receiving device and therefore the entire receiving device are connected torsion-proof to the segregating device. If the rotation position of the segregating device is specified, accordingly also the rotation position of the receiving device is specified, although the singularizing the device can be twisted vis-à-vis both of these components. To make the user aware of the direction of rotation, a corresponding rotation arrow 335 (FIG. 4, 7A) is applied onto the segregating device (either printed, or impressed or embossed).

The singularizing device 200 further has an outside ratchet track 250 in the edge section on the outside, which is facing the screwed connection 210, 720 with the storage container 700 (FIG. 6A). The axial leg 420 of the receiving device 400 is equipped on its end with an inside latch element 460 opposite of it (FIG. 8B). The ratchet track and the latch element are oriented equidirectional, i.e. their ratchet steps block one another. The latch element engages into the ratchet track of the singularizing device and engages with it in the assembled state. This prevents twisting the singularizing device clockwise (viewed from the front face 110 of the dispensing device 100 to the storage container 700) vis-à-vis the receiving device and therefore also vis-à-vis the segregating device 300. The step length and therefore the number of the ratchet steps on the perimeter of the singularizing device are moreover selected such that this corresponds to the angular distance between two adjacent chambers 230. During twisting of the singularizing device vis-à-vis the receiving device and the segregating device by one ratchet step, the singularizing device is accordingly rotated further by an angular value that corresponds to the singularizing and dispensing of one single solid portion F. The number of twisting steps therefore indicates the number of the solid portions that have entered the dosing tube 440, so that dispensing can be controlled even easier.

Figure 9A:
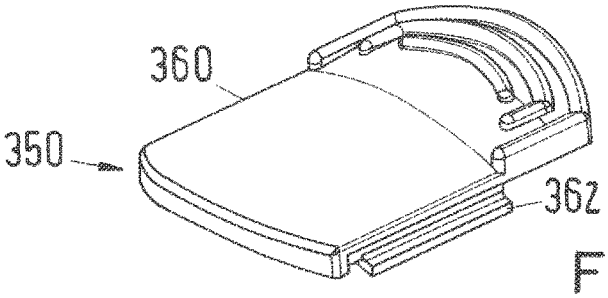
Figure 9B:
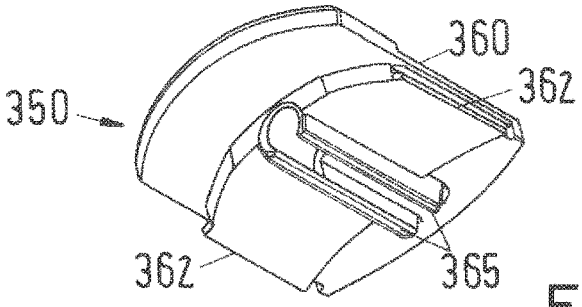

The anti-rotation element 350 serves to block the twisting of the singularizing device 200 vis-à-vis the receiving device 400 and the segregating device 300. The anti-rotation element is developed by the locking element in form of a sliding element 360 (FIG. 9A, 9B). The sliding element is disposed opposite the apron 310 on the axisymmetrical casing 330 of the segregating device 300 (FIG. 4, 5). For this purpose, the casing has a cutout 338 in the corresponding area (FIG. 7A). To support the sliding element, it reaches with guide flanks 362 under the surface shell of the segregating device. One end of said sliding element moreover bears on a recessed casing section 339 (FIG. 7A, 9A, 9B). The sliding element is pre-loaded by a tensioning element, here a compression spring 370, which is guided on the underside of the sliding element between two ribs 365 protruding downwards and which is attached to the segregating device in axial direction, so that it is pushed away from the front face 340 of the segregating device (FIG. 3B, 5, 9B). In place of a spiral spring, a leaf spring can also be used. In this (locking) position, the ribs engage in locking grooves 265 on a radial protruding edge 260 of the singularizing device 200 and therefore block the twisting of the singularizing device vis-à-vis the segregating device (FIG. 3A, 6A). Like the chambers 230 and the steps of the ratchet track 250, adjacent locking grooves are disposed for example at an angular distance of 36° to each other for the step-by-step twisting of the singularizing device vis-à-vis the receiving device, so that 10 pairs of locking grooves are disposed regularly distributed in the edge, for example. In this way, the twisting of the singularizing device can be blocked in a controlled manner after releasing one solid portion F, so that no additional solid portion can be released. This blocking can be canceled, in that the sliding element is advanced against the force of the tensioning element, since the ribs then no longer engage in the locking grooves.

Furthermore, the sliding element 360 in the release position protrudes across the discharge opening 445 of the dosing tube 440 and protects it in this position and therefore also the entire interior space of the dispensing device 100 against the penetration of contaminants.

If the dispensing device 100 according to the invention is provided to a user together with a storage container 700, both a sealing foil 600 as well as a tamper-proof closure 500 must be applied, wherein the latter in the undamaged state indicates that the storage container has neither been opened nor has been used prematurely. As a result this will also ensure that a premature use will not occur (FIG. 10, 11).

The sealing foil 600 serves for forming a vapor and oxygen barrier above the interior space of the storage container 700 (FIG. 11). It seals the discharge opening 715 of the discharge spout 710 tightly. The sealing foil can be a two-layer foil, such as a polypropylene foil laminated with aluminum. Such foils are also utilized for the production of blister packs in the pharmaceutical area as well as for sealing of foodstuffs. The sealing foil is hot-rolled (sealed) onto the discharge opening of the storage container, for example onto the neck of a tablet bottle. In the present case, this foil has a laterally protruding tab 610 for pulling the foil off the discharge opening.

The tamper-proof closure 500 is developed in form of a ring, which is pulled over an edge on the discharge spout 710 of the storage container 700 and which then snaps under this edge (so it can be twisted). For this purpose, the tamper-proof closure has upright first latch fingers 510, which engage behind a rim 730 on the discharge spout. The tamper-proof closure furthermore has inward facing second latch fingers 520. These engage with the singularizing device 200 of the screwed-on dispensing device 100 according to the invention, in that the inward facing second latching fingers engage in a ratchet collar 270 on the end of the container of the singularizing device. By also engaging the first latching fingers on stop notches 740 below the rim 730, this impedes twisting of the dispensing device vis-à-vis the storage container. The tamper-proof closure moreover ensures that the dispensing device cannot be screwed onto the discharge spout of the storage container far enough so that the partition wall 380 protruding inward is seated on the sealing foil 600 of the discharge opening 715 and potentially damages it. To be able to screw the dispensing device tightly onto the storage container, the tamper-proof closure must first be removed for initial use. For this purpose, it has a grip area 530 and a predetermined break-off-line 540 next to the grip area. The tamper-proof closure can be broken by pulling forcefully on the grip area and can subsequently be removed. This permits the dispensing device to be screwed-off the storage container, to pull-off the sealing foil and after screwing the dispensing device on again release the solid portions F singularized from the storage container.

Figure 6B:
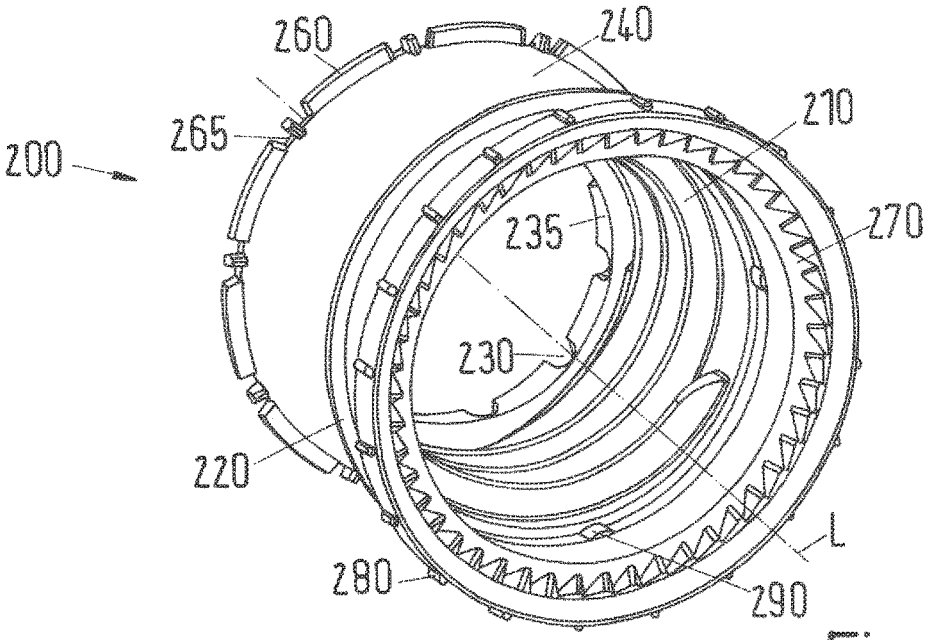

For screwing the dispensing device 100 according to the invention onto the discharge spout 710 of the storage container 700, the singularizing device 200 has peripheral knurling 280 which assists with holding the dispensing device by hand and screwing it tightly onto the storage container (FIG. 6A, 6B). In addition, the singularizing device is further equipped with snap lugs 290 on the inside in an area between the screw thread 210 and the ratchet collar 270 (FIG. 6B), which snap lugs engage behind the stop notches 740 below the rim 730 on the discharge spout during the screwing onto the storage container (FIG. 2).

A first variant of a second embodiment of a dispensing device 100 according to the invention is illustrated in FIG. 13-21. This dispensing device being coupled to a storage container 700 is rendered in FIGS. 13 and 14.

The dispensing device 100 according to the invention of this first variant of the second embodiment is shown in FIG.

13 in a position of use for solid portions F, i.e. the dispensing device with its front end is disposed inclined slightly down. In the position of use, a central longitudinal plane extends parallel to the singularizing device 200 developed in form of a wheel or a ring and perpendicular and along a longitudinal axis of the device.

Figure 13B:
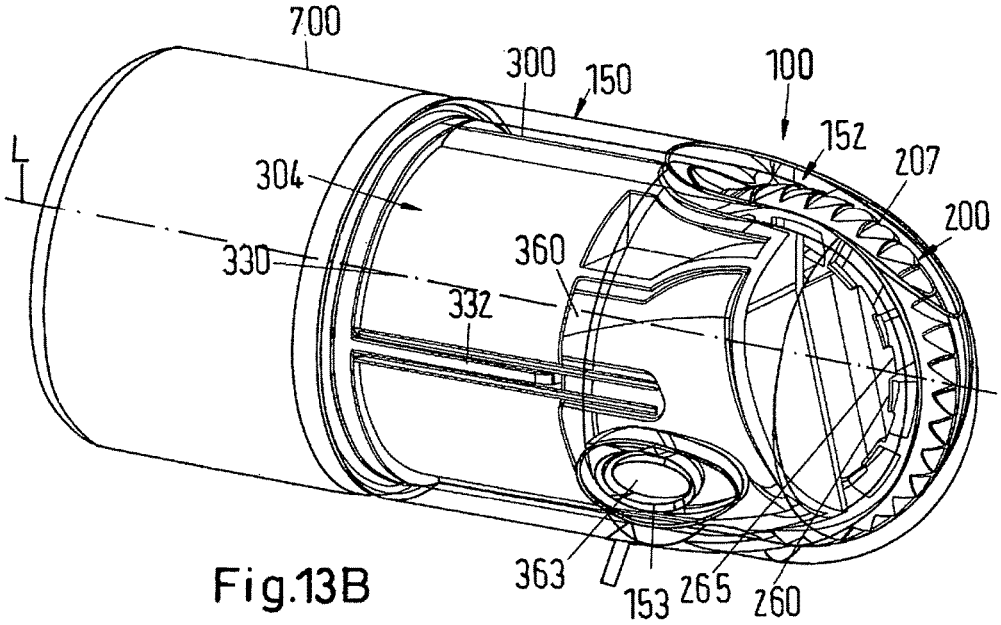
Figure 18A:
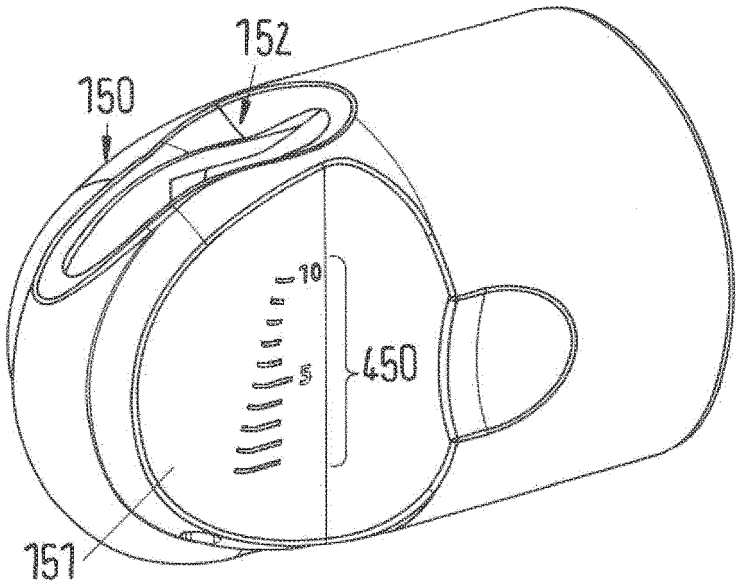
Figure 18B:
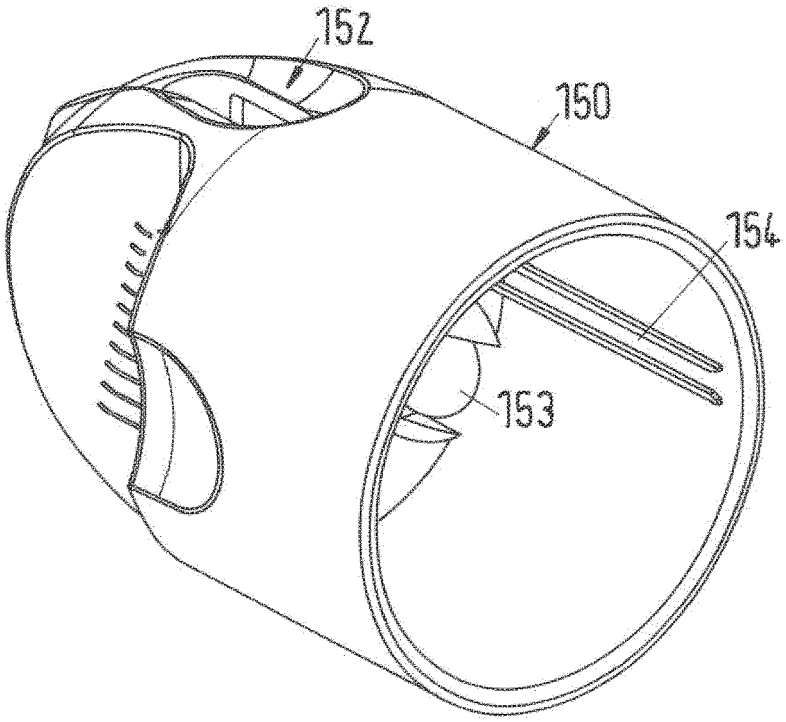

The dispensing device 100 has a transparent housing outer skin (shell) 150 (FIG. 13A, 13B, 18A, 18B), which includes further components in its interior, in particular the singularizing device 200, a segregating device 300 and a receiver 440. The housing outer skin is produced from a transparent synthetic, for example, so that the singularizing and separation of the solid portions F during the actuation of the dispensing device is visible from outside. The base of the housing outer skin, which abuts on a linked-up storage container 700, is formed by an essentially cylindrical shaped hollow body. This hollow body spreads on the end opposite of the storage container on the one side into a front shaped as a half-shell (FIG. 13B, 13B, 18A, 18B). On the other side on this end, the housing outer skin is shaped sloping-down to the inside (FIG. 13A, 18A, 18B), so that at this point the outside wall forms a partially parallel sidewall 151 vis-à-vis the perpendicular central longitudinal plane of the dispensing device. The housing outer skin on the end opposite of the storage container in an upper area along the perpendicular central longitudinal plane is further penetrated by a slot 152 through which the singularizing device grips (FIG. 13A, 13B). In addition, a further opening 153 is positioned laterally on the half-shell shaped front, through which opening a knob 363 of an unlocking probe 360 can be actuated (FIG. 13B).

In this second embodiment, the singularizing device 200 (FIG. 13A, 13B, 15A, 15B) is developed by a wheel or a ring. The central longitudinal plane, in which this wheel or this ring is, extends parallel to a longitudinal direction of the dispensing device 100 and in the use position for solid portions is perpendicular. The rotational axis 205 of the singularizing device is therefore positioned horizontally, specifically at a right angle to the longitudinal plane of the dispensing device. The singularizing device is provided with profiling 207 so that it can be held conveniently by hand and consequently be rotated easily. For this purpose, the wheel in the assembled state projects from the inside into the slot 152 in the housing outer skin 150, so that it can be held by a user for example with one finger, while the user holds the dispensing device with the hand. The singularizing wheel can therefore be operated with one finger, same as the scrolling wheel of a mouse for a PC. The wheel has a peripheral one-sided shoulder 235 on the inside, which forms a stepwise transition from a round area 236 oriented towards the rotational axis to one of the lateral surfaces of the wheel. For example, into this stepwise shoulder 12 round recesses 230 are introduced equidistant, i.e. at the same angular distances of 30° for example, in each case. These recesses therefore open towards the inner side and towards the one lateral surface of the wheel. In the assembled state of the singularizing device, these recesses are forming chambers 230 for one solid portion each, since because of their size and shape they can each accommodate exactly one solid portion. Furthermore, on the inside of the wheel, on the lateral surface positioned opposite the chambers, there are essentially rectangular rib areas 260 disposed at equal angular distances which are reciprocally segregated by essentially rectangular notches 265, which rib areas serve the locking of the singularizing device. Laterally in the rectangular rib areas specifically on the side facing away from the recesses, there are further ratchet-shaped formed flat pockets for preventing the rotation of the wheel in a direction opposite to that of the singularizing device. These pockets are forming a ratchet track 250. In the assembled state, the singularizing device sits with a positive joint in a hollow space in the housing outer skin but is freely rotatable in one direction of rotation. The chambers are closed by the parallel sidewall 151 of the housing outer skin 150 (FIG. 18A) to the side, so that they are only open towards the inner side of the singularizing wheel.

Figure 16A:
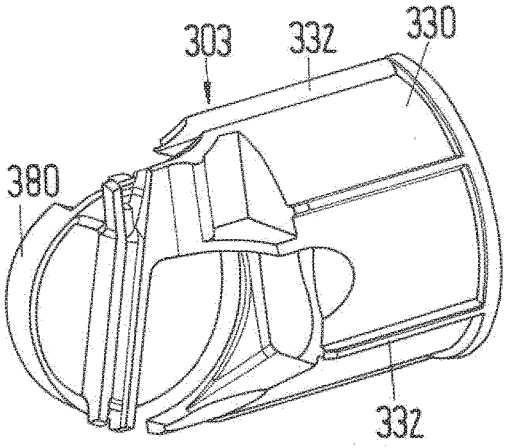
Figure 16B:
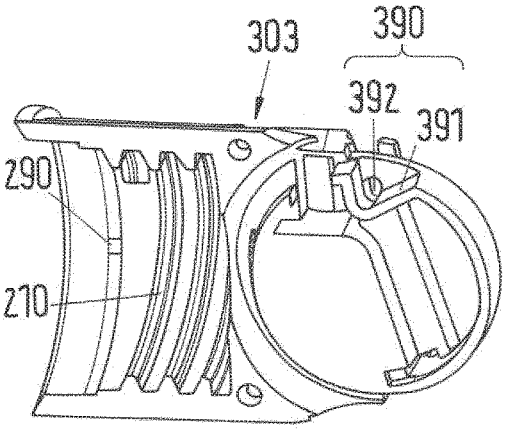
Figure 17A:
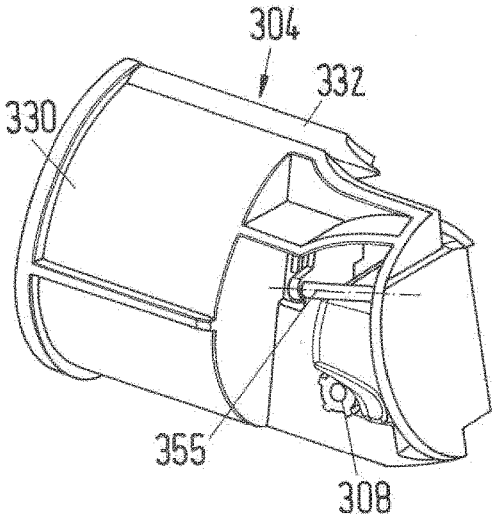
Figure 17B:
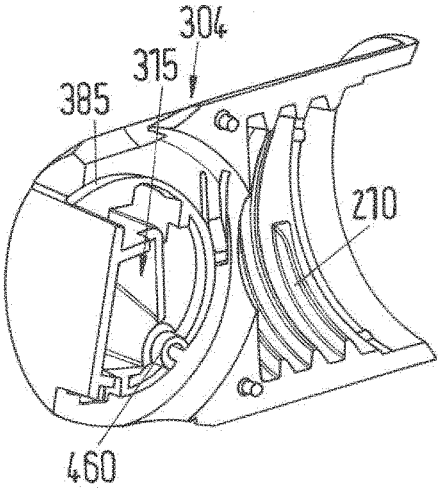

The segregating device 300 is formed by means of two half-shell elements (FIG. 16A, 16B: first half-shell element 303; FIG. 17A, 17B: second half-shell element 304), which can be connected to one another by a positive joint. These two half-shell elements are fixedly inserted into the housing outer skin 150 without maneuver clearance and jointly form the segregating device. The segregating device can be inserted into the housing outer skin, for example, and be held in it by means of a frictional connection.

Figure 20A:
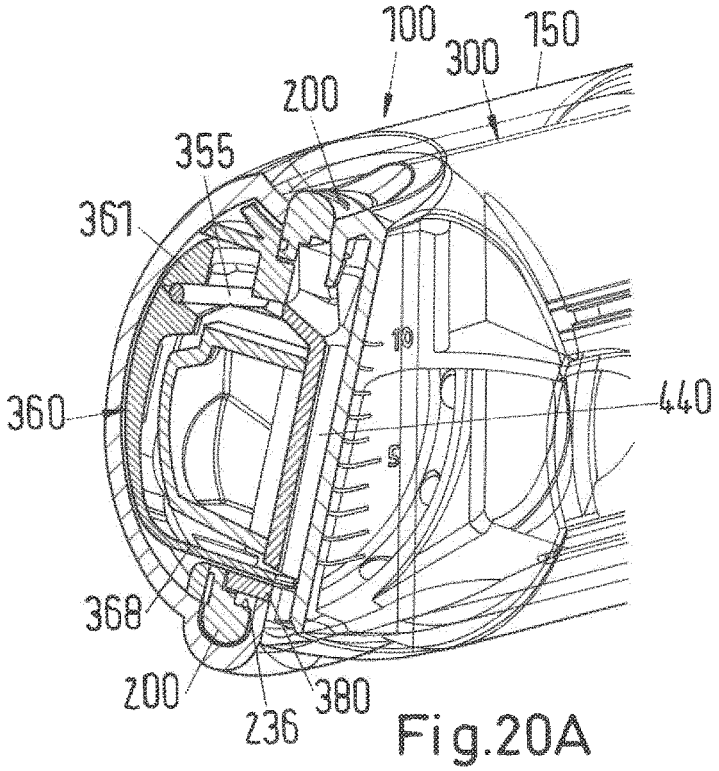

The second half-shell element 304 has a circular rear shaped guideway section 385 for the singularizing wheel 200. The first half-shell element 303 has a separating device in form of a partition wall 380 that is developed like the rear guideway section with a circular front face and extends at a small distance to the round area 236 of the singularizing wheel (FIG. 20A). The partition wall is wide enough so that it can cover the recesses 230 that are introduced into this round area in the singularizing wheel. It therefore prevents that the solid portions F accommodated in these recesses (chambers) can drop out during the rotation of the wheel. The partition wall is disposed on the front end of the dispensing device 100, specifically on the end facing away from the storage container 700. Both the partition wall of the first half-shell element of the segregating device as well as the guideway section of the second half-shell element of the segregating device 300 extend respectively approximately across a semicircular area.

The segregating device 300 formed by the two half-shell elements 303, 304 has an internal thread 210 for screwing the segregating device onto the external thread 720 on the discharge spout 710 of a storage container 700 (FIG. 2). Snap lugs 290 are moreover located on the inside wall in the segregating device (FIG. 16B), which snap lugs can engage behind the corresponding stop notches 740 below the rim 730 on the discharge spout of the storage container 700.

On the first half-shell element 303 of the segregating device 300 the semicircular partition wall 380 transitions into a ramp 391. This, same as the partition wall section closing the chambers 230 for the solid portions F, is in the motion path of the chambers. Consequently, the solid portions can drop from the chambers onto this ramp, after the chambers have been moved out of the area of the partition wall. This ramp leads into a feedthrough duct 392. This ramp and the feedthrough duct jointly form a chute 390 (transfer path) for the solid portions. This chute terminates in a receiver 440 (FIG. 13A, 20A).

Figure 21A:
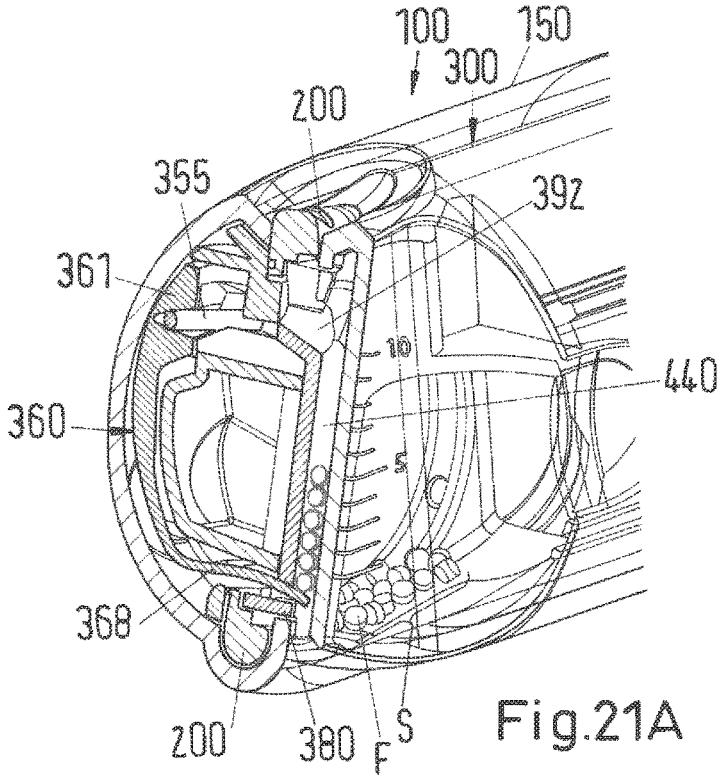

The receiver 440 for the solid portions F in this first variant of the second embodiment is part of the segregating device 300 and is therefore developed with it as one piece. The receiver is developed as an elongated groove, so that the solid portions are contained in it stacked on top of one another (FIG. 13A, 21A). In FIG. 21A, six solid portions can be seen stacked on top of one another. The groove is disposed approximately rectangular to the longitudinal axis of the segregating device, specifically in a horizontal position of the dispensing device 100 to the bottom and inclined slightly forward at the bottom end. In the position of use of the dispensing device 100, same is kept tilting slightly forward, so that this groove is then aligned essentially perpendicular. As a result, the solid portions drop essentially perpendicular into the groove. In the assembled state, the groove is closed by the sidewall 151 of the housing outer skin 150 which is partially parallel to the perpendicular central longitudinal plane of the dispensing device, so that the groove is developed as receiving duct. As a result, solid portions dropping into the receiving duct can be kept therein stacked on top of one another.

The closing outside wall of the housing outer skin 150 is provided outside at this point with a dosing scale 450 (FIG. 13A), against which the groove bears. The scale graduation of the dosing scale indicates the solid portions F filling level of the receiving duct 440 formed by the groove, so that the number of solid portions that have reached the receiving duct can be detected at a glance. During singularizing and segregating of solid portions from the bulk body S (actuation position), the receiving duct is closed to the bottom by means of a latching finger 368 (FIG. 21A). This barrier is enabled again for releasing the solid portions (dispensing position) (FIG. 20A).

A desiccant for the solid portions F can be accommodated in a hollow space 315 of the segregating device 300 (FIG. 17B), which hollow space is located above the receiving area for the bulk body S in the second half-shell element 304.

Figure 19A:
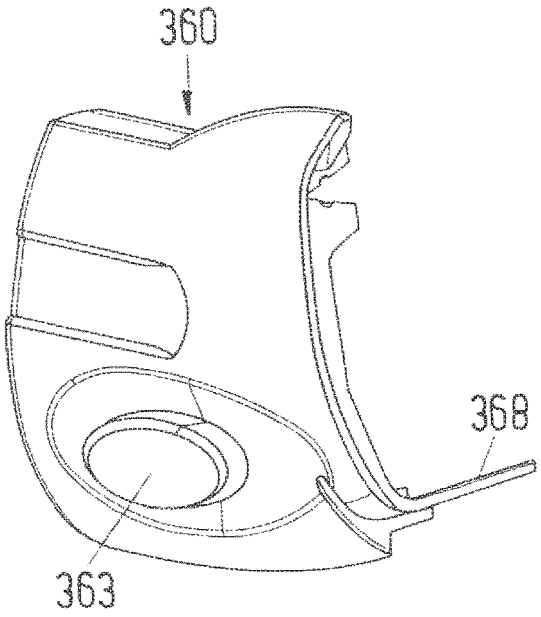
Figure 19B:
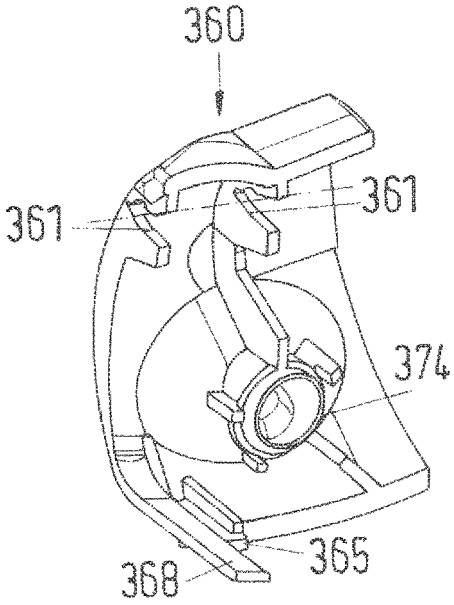

The dispensing device 100 further has an unlocking probe 360, which has both a locking element 365 for locking the twisting of the singularizing wheel 200 as well as the portion barrier 368 for closing the receiving groove to the bottom (FIG. 19A, 19B). The unlocking probe extends externally across a partial area of the second half-shell element 304 of the segregating device 300, where it is held pivotable. The second half-shell element on its outside has a pivot axis 355 for holding the probe (FIG. 17A), which can be engaged in corresponding ties 361 on the inside of the probe, so that the probe can be pivoted about this axis (FIG. 19B, 20A, 21A). The probe further has a control knob 363 in the lower area, which knob extends through a corresponding opening 153 in the housing outer skin 150 of the dispensing device, so that the probe can be actuated from outside (FIG. 13B). The probe supports itself by means of a compression spring (not illustrated) against the outside of the second half-shell element 304 of the segregating device 300. For this purpose, the probe on its inside has a protruding spring holder 374 for the compression spring, which supports itself against a correspondingly disposed and formed holder 308 on the outside of the second half-shell element. As a result, in the relaxed position the probe is pushed outside and for actuation can be pushed inside through the opening in the housing outer skin.

Figure 20B:
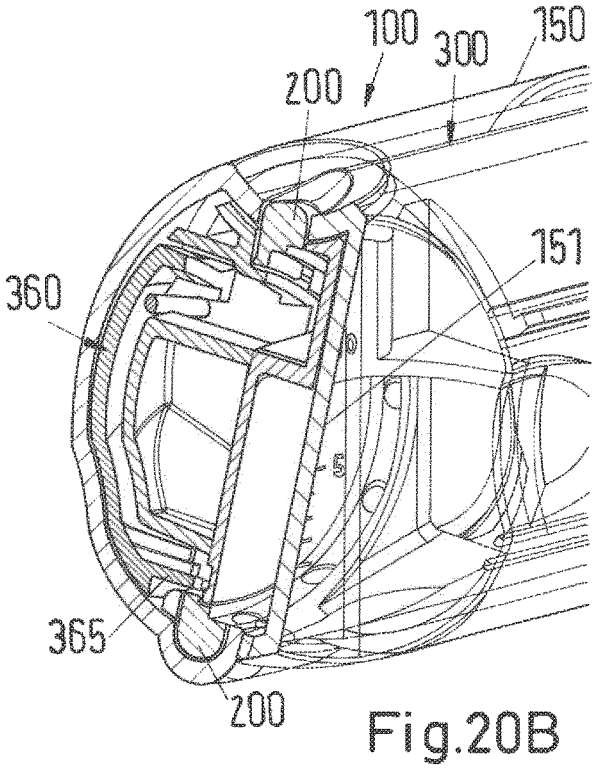
Figure 21B:
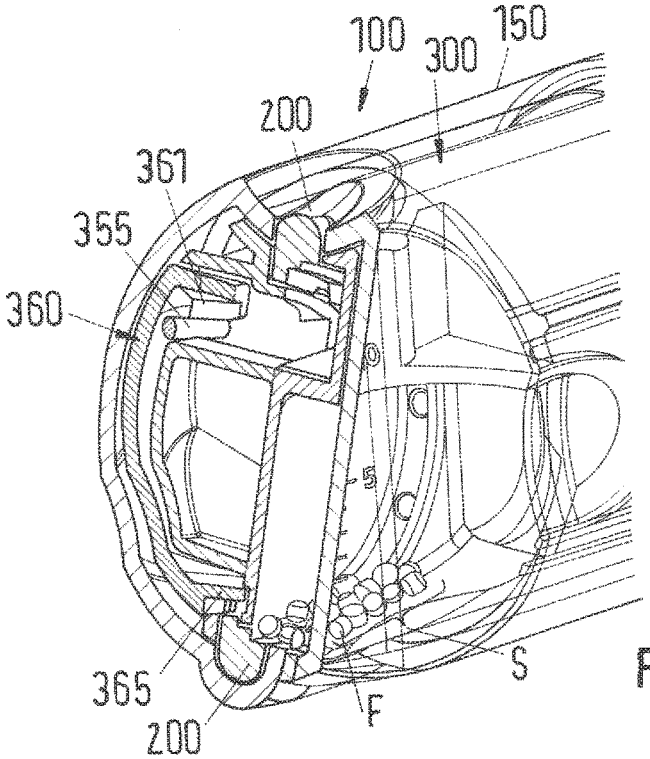

For locking the singularizing wheel 200, the probe 360 has the locking pawl 365 in the form of a catch on its bottom edge (FIG. 19B), which in the relaxed position of the probe engages in one of the locking grooves 265 between the rib areas 260 on the inside of the singularizing wheel and therefore prevents the rotation of the wheel. In FIG. 20B it is shown that the locking pawl is positioned closely above the singularizing wheel and therefore in one of the locking grooves. By pushing the probe against the spring force, the locking pawl is swiveled out of the locking groove and consequently releases same. This is illustrated in FIG. 21B: The unlocking probe is pushed to the inside (which can be seen by the larger space between the latching probe and the housing outer skin 150), so that the locking pawl is swiveled further to the right and also to the top. This results in a larger space between the locking pawl and the singularizing wheel. As result of this design, this accomplishes in a simple manner that it prevents not only an accidental actuation of the dispensing device 100 according to the invention, but also efficiently realizes a child safety lock. Because the locking element is automatically pushed into the locking position by the spring force, in order to dispense solid portions it must be intentionally pushed open and be kept in this position during the dispensing. The complexity of this combination of different actuations prevents children from using the dispensing device.

The unlocking probe 360 furthermore has the portion barrier in form of a latching finger 368 (FIG. 19A, 19B). In the relaxed state, the latching finger shuts off the receiving duct 440 to the bottom, so that any solid portions F contained therein cannot drop out (FIG. 21A). When actuating the probe, this finger is pushed into the duct, so that it shuts it off to the bottom. Because of this swivel motion, the finger is not only moved in the direction in which the finger extends, but also slightly upward. As a result, the finger strikes against the bottom edge of the receiving duct but at the same time is also bent slightly down. In this way, the lower position of the finger in the closing position is defined by the lower edge of the receiving duct.

Furthermore, a latch element in form of a ratchet finger 460 is located on the inside of the second half-shell element 304 of the segregating device 300, which ratchet finger in the assembled state is disposed at the level of the external ratchet track 250 of the singularizing wheel 200. This ratchet finger pushes against the ratchet profile and enforces that the singularizing wheel can be rotated exclusively in one direction D (FIG. 13A), specifically in direction of the front part of the wheel extending upwards viewed from front of the dispensing device 100. Because the ratchet pockets follow each other at angular spacing corresponding to those at which the recesses 230 follow each other in the singularizing wheel, at each step during the rotation of the singularizing wheel, a single solid portion F is singularized and segregated because of the ratchet profile.

For the use of the dispensing device 100, same is screwed onto a storage bottle 700 (FIG. 13A, 13B, 14) instead of a cap. The solid portions F within the storage container during tilting of the ensemble of the dispensing device and the storage container move to the front into the dispensing device and collect in an area directly behind the receiving duct 440 and above the chambers 230 running through. There, the solid portions form a bulk body S (FIG. 13A, 14).

To singularize and segregate a specific number of solid portions F, a user picks up the dispensing device 100 with the right hand for example and actuates the control knob 363 on the right side of the device by pushing the knob against the spring force of the compression spring. As a result, the unlocking probe 360 is actuated. On the one hand, this causes the locking pawl 365 of the unlocking probe to be swiveled out from a groove 265 between the protrusions 260 on the inside of the singularizing wheel 200, so that the singularizing wheel is released, and on the other that the latching finger 368 of the unlocking probe is pushed below the lower open end of the receiving duct 440, closing same to the bottom.

Since the singularizing wheel 200 is now released (actuation position), the user can turn it with its thumb in the direction of rotation D towards himself (FIG. 13A). In this context, the ratchet finger 460 drags on the lateral ratchet profile 250 of the singularizing wheel and subdivides the rotation into angular steps, which correspond to the reciprocal angular distance of the recesses 230 in the singularizing wheel. This ratchet profile moreover prevents a rotation in the opposite direction. As a result of the rotation, solid portions F are picked up from the bulk body S in the recesses on the inside of the singularizing wheel traversing this bulk body and are conveyed with the singularizing wheel on a motion path B to the top and out of the bulk body (FIG. 14). To prevent the solid portions contained in these recesses from dropping out during conveyance, the partition wall 380 of the first half-shell element 303 of the segregating device 300 as a separating device is positioned at a small distance opposite the motion path of the chambers. Once the chambers with the solid portions have departed from the area of the partition wall, the solid portions drop out of the chambers while inevitably arriving at the ramp 391 and from there in the feedthrough duct 392, which jointly form the transfer path 390 (FIG. 14). Since the feedthrough duct terminates directly in the receiving duct 440, the solid portions drop into same and are stacking on top of one another therein (FIG. 21A). Because of the scale graduation of the dosing scale 450 it can be immediately seen how many solid portions have already been separated. Moreover, by the stepwise rotation of the singularizing wheel, the number of the singularized and segregated solid portions can be checked.

After the user has transferred the desired number of solid portions F into the receiving duct 440, the user can discontinue the further singularizing and separation by not continuing to rotate the singularizing wheel and also releasing the unlocking probe 360 again, so that the rotation of the singularizing wheel 200 is blocked on the one hand, in that the locking pawl 365 engages again in one of the locking grooves 265 of the singularizing wheel (FIG. 20B), and on the other that the receiving duct is enabled again to the bottom, and that the locking finger 368 disengages from the duct level (release position; FIG. 20A). As a result, the solid portions can drop out of the receiving duct.

The following description of the second variant of the second embodiment of the dispensing device 100 according to the invention is limited to the structural differences compared to the first variant. This second variant is suitable for operation by left-handed and by right-handed persons.

Figure 25A:
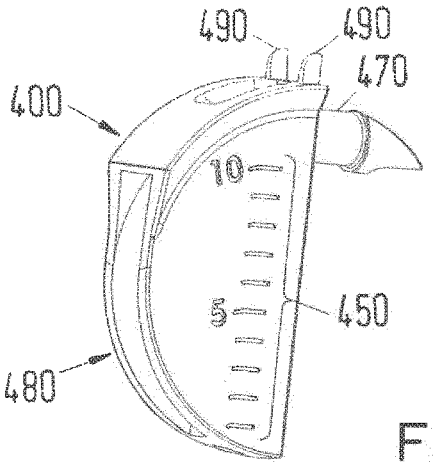
Figure 25B:
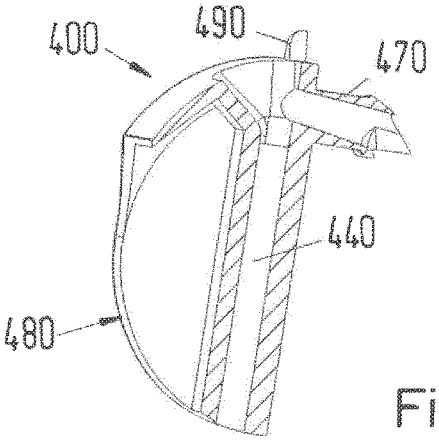

For this purpose, the receiving device 400 of this variant contrary to the first variant is designed as separate and pivotable component within the dispensing device 100 (FIG. 25A, B). The receiving device is inserted into the housing outer skin 150, which for this has an opening directly behind the front part accommodating the singularizing wheel 200 (FIG. 22A, B). This opening has the shape of a main body 480 of the receiving device (semicircular; FIG. 25A, B). The receiving device contains a receiving duct as receiver 440 and is not developed by a groove as constituent part of the segregating device 300, as is the case in the first variant (FIG. 25B). The receiving device has a main body 480 with the receiver that is open to the top and with a dosing scale 450 that is applied externally preferably on both sides.

At the upper end of this main body is a laterally protruding tube (overflow tube) 470, which communicates with the receiver and is also open towards the unsupported end. Same as the receiver, also the overflow tube has an inner width sufficient to permit passage of solid portions F. The receiving device is preferably produced from a transparent material, so that the solid portions contained therein are visible from outside.

The receiving device 400 with the overflow 470 is inserted into an opening of the segregating device 300 so that it can be twisted, so that it is inserted in the manner of an axis into the opening, which forms a pivot bearing for this axis. This opening forms during assembly of a first half-shell element 303 designated as adapter (FIG. 23A, B) and of a second half-shell element 304 designated as wheel support (FIG. 24A, B) of the segregating device by means of the cutouts designated 336. When fitting the receiving device in the segregating device, the main body 480 of the receiving device penetrates the segregating device in the area of the wheel support, which area is limited by the partition wall (separating device) 380 on the adapter to the front and by an end rib 337 on the wheel support to the back. In this manner, the main body of the connecting device can be swiveled through the openings in the housing outer skin 150 and in the segregating device (FIG. 26, 27A).

The unrestricted pivotability of the receiving device 400 is limited merely by two latch stubs 490 attached in the upper area of the main body 480 of the receiving device, which latch stubs extend into the interior of the dispensing device 100, which interior is covered by the housing outer skin 150, since said latch stubs are disposed at the level of the flanks of the singularizing wheel 200 and during swiveling of the receiving device in each case one of said stubs will be positioned on a corresponding flank of the wheel. Moreover, latching means (not illustrated) are provided, which can engage the receiving device in a central swivel position, in a left lateral swivel position or in a right lateral swivel position.

The singularizing wheel 200 has indentations 255 on both flanks 237, one of which said recesses is respectively positioned centered between two adjacent recesses 230, which are forming the chambers (FIG. 29A, B). The respective latch stub 490 engages in these indentations when the receiving device 400 is positioned in one of the two lateral swivel positions and thus blocks the rotation of the singularizing wheel.

Figure 24B:
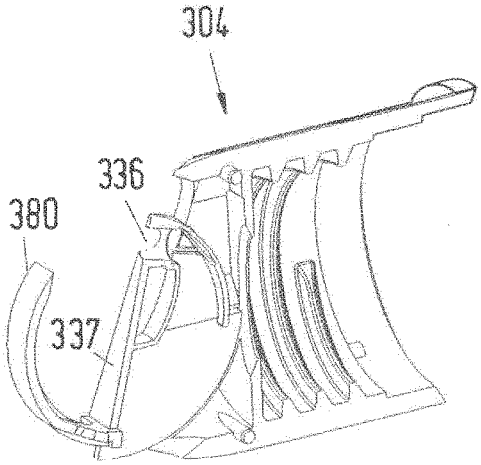

The segregating device 300 is formed by the first half-shell element 303 and the second half-shell element 304, wherein the side that can be seen in FIG. 23B is fitted bearing against the side that can be seen in FIG. 24B, so that the ribs 337 are forming a continuous surface facing to the front. The singularizing wheel 200 is inserted between the two half-shell elements freely rotatable. The singularizing wheel is guided by means of the separating device (partition wall) 380 of the second half-shell element and the guideway section 385 of the first half-shell element.

Figure 28B:
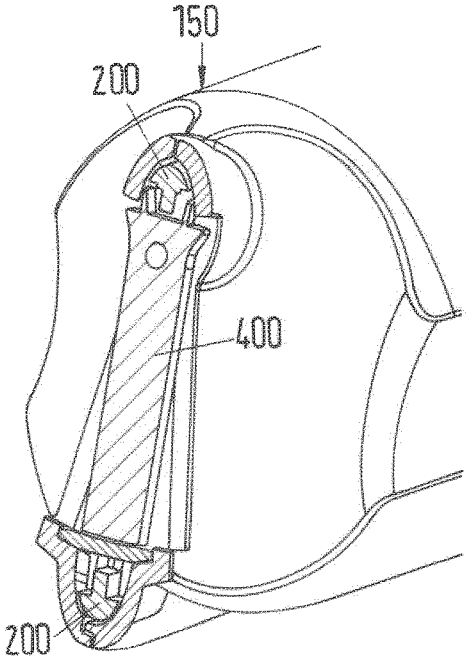

When the receiving device 400 is in the central swivel position, the receiving duct (receiver) 440 is closed to the bottom by the partition wall 380 (FIG. 28A), which is a constituent part of the second half-shell element 304 of the segregating device 300. In this swivel position, the latch stubs 490 of the receiving device do not block the rotation of the singularizing wheel 200, since in this position they are spaced apart from the flanks of the singularizing wheel (FIG. 28B). When swiveling the receiving device into the left or into the right lateral swivel position, the receiving duct is open to the bottom (FIG. 26, 27A). Although the housing outer skin 150 extends up to below the receiving device in these positions, however both on the left as well as also on the right at the position of the discharge opening 445 of the receiving duct it has a discharge opening 155 in each case, through which the solid portions F can be output out of the receiving duct.

For operating the dispensing device 100 according to the invention in this variant, it can be held either with the right or with the left hand, wherein the person holds the dispensing device essentially aligned horizontally (position of use) and wherein one of the fingers, for example the index finger, is positioned on the external profiling 207 of the singularizing wheel 200 protruding to the outside through the slot 152 in the housing outer skin 150, and said person can rotate said singularizing wheel when the receiving device 400 is in the central (unlocked) swivel position. By rotating the wheel, the solid portions F are conveyed into the receiving duct 440 (FIG. 22A, B, 28A). As soon as a sufficient number of the portions is present in the receiving duct, the operating person pushes by means of the thumb into the opposite direction of the thumb, so that the receiving device occupies the respective lateral swivel position. As a result, the singularizing wheel is locked on the one hand in that one of the latch stubs 490 engages in one of the indentations 255 on the flanks of the singularizing wheel (FIG. 27B), and on the other, the solid portions present in the receiving duct are released from the receiving duct, because in this position the receiving duct is open to the bottom (FIG. 26, 27A). Since the receiving device can be swiveled into both directions, it can be operated in the stated manner by means of the left hand as well as with the right hand.

If the receiving duct 440 has been completely filled during singularizing and transfer of the solid portions F (actuation position), any further succeeding solid portions are carried off again via the overflow tube 470. Since this tube opens within the interior space of the dispensing device 100, the surplus singularized solid portions drop back again into the bulk body S.

Furthermore, the second variant of this embodiment of the dispensing device 100 according to the invention has a design of the singularizing wheel 200 which ensures very gentle handling of the solid portions F. By providing the inclined ramps 234 between adjacent recesses (chambers) 230, 230', 230" on the inside of the singularizing wheel, it is largely prevented that two solid portions entangle within the area of the chambers, if there is the risk that both solid portions could drop into the same chamber in the singularizing wheel. These ramps are designed as running surfaces for the solid portions. The solid portions are held on these running surfaces by means of wall sections of the housing outer skin 150 disposed on the side of the singularizing wheel, specifically partially below the opening in the housing outer skin for accommodating the receiving device 400, so that a channel for the solid portions is formed between these wall sections, the bottom of which channel is defined by the running surfaces. The running surfaces extend respectively from a high level $N_1$ above a chamber base 232 of a respective first chamber 230 to a low level $N_2$ above a chamber base 232' of a second chamber 230' adjacent to the first chamber in a direction of rotation D of the singularizing wheel. The chamber base 232 is at the level $N_0$. The depth of the chambers on the side, at which the high level is, is $N_1-N_0$, and the depth of the chambers on the side, at which low level is situated, is $N_2-N_0$.

Even if the embodiment illustrated in FIG. 30 has further differences to the embodiment of a singularizing wheel 200 of the second variant of the second embodiment of the dispensing device 100 shown in FIG. 29A, B, it is possible to easily recognize the principle of this advantageous design by means of this example, however: a running surface 234 for the solid portions F located between two adjacent recesses of a first chamber 230 and a second chamber 230' on the inside of the singularizing wheel, has an angle $\alpha>0°$ vis-à-vis a secant Sk connecting these two adjacent recesses (relative to a circle center of the singularizing wheel). For this reason, viewed from the recess of the first chamber 230, the recess of the second chamber 230' in the direction of rotation D is partly cut by this running surface, so that any additional solid portion is pushed across above the solid portion already present in the recess of the second chamber, without being able to jam on the wiping edge of the recess. However, the cut recess again has a complete depth $N_1-N_0$ on the side located in the direction of rotation. From this point, a further running surface starts to yet a further recess of a third chamber 230" located in the direction of rotation, which cuts this further recess again on the wiping side opposite to the direction of rotation. On each of the wiping sides of the recesses opposite to the direction of rotation, the running surface above the recess base has a sufficient depth, so that any solid portion present in the recess would protrude with its lenticular upper side barely above the wiper edge. This depth corresponds approximately to ⅔ of the diameter of the solid portion.

The same principle is also realized in the embodiment of the singularizing wheel 200 for the second variant of the second embodiment of the dispensing device 100 according to the invention (FIG. 29A, B). In this case, the recesses 230 are introduced in a central rib 238 on the inside of the singularizing wheel. The running surfaces 234 for the solid portions F connecting these recesses in each case also extend at an angle $\alpha>0°$ vis-à-vis secants in this case, which connect to adjacent recesses.

This configuration of the inside of the singularizing wheel 200 with inclined running surfaces 234 can also be used in other embodiments of the dispensing device 100 according to the invention, for example in the first embodiment.

Indentations 255 are located in the flanks 237 of the central rib 238 of the singularizing wheel 200, which indentations are provided for the locking of the singularizing wheel by means of latch stubs 490 on the receiving device 400. These recesses are therefore positioned on both sides of this central rib (FIG. 29A, B).

The above described component parts of the embodiments can be developed from a synthetic, especially preferably from an opaque material (except for the observation window or the housing outer skin or the receiving device). Also metal can be selected for individual component parts, for example for the tensioning element 370, or a ceramic material. The tensioning element can also be produced from synthetic.

LIST OF REFERENCE SYMBOLS

100 dispensing device
110 front face of dispensing device
150 housing outer skin
151 front planar sidewall of the housing outer skin
152 upper slot in the housing outer skin
153 opening for the unlocking probe
154 longitudinal slot
155 discharge opening
200 singularizing device, singularizing wheel
205 rotational axis of the singularizing device
207 profiling of the singularizing device
210 internal thread, screw thread
220 snap ring
230, 230', 230" cutouts, recesses, (first, second, third) chambers
232, 232' chamber base
234 running surface for solid portions, ramp
235 inner shoulder
237 flank
238 central rib
236 round area
240 axisymmetrical casing
250 external ratchet track of the singularizing device
255 indentation on one flank
260 protruding edge, rib areas

265 locking grooves, openings, notches
270 ratchet collar
280 knurling
290 snap lugs
300 segregating device
303 first half-shell element of the segregating device
304 second half-shell element of the segregating device
308 holder for a compression spring
310 apron
315 hollow space for accommodating desiccant
320 front inner surface
330 axisymmetrical casing section, cylindrical outer casing area
332 longitudinal brace
335 rotation arrow
336 cutouts for forming an opening
337 end rib
338 cutout in casing section
339 recessed casing section
340 frontal cap
342 observation window
350 anti-rotation stop
355 pivot axis for unlocking probe
360 sliding element, locking knob, unlocking probe
361 ties for pivotable support of the unlocking probe
362 guide flanks
363 control knob
365 locking element (rib, locking pawl) on locking element
368 retaining finger, portion barrier
370 tensioning element, (resetting) spring
374 spring holder
380 partition wall, separating device
385 guideway section
390 transfer path
391 funnel section of the transfer path, ramp
392 feedthrough section (duct) of the transfer path
400 receiving device
410 frontal leg
420 axial leg
430 snap hook
440 dosing tube, receiver, receiving duct
445 discharge opening
450 dosing scale
460 latch element
470 overflow route, overflow tube
480 main body of the receiving device
490 latch stub
500 tamper-proof closure
510 upright first latch fingers
520 inward facing second latch fingers
530 grip area
540 predetermined break-off line
600 sealing foil
610 tab on the sealing foil
700 storage container, tablet bottle
710 discharge spout
715 discharge opening
720 external thread, screw thread
730 rim on discharge spout
740 stop notch
B motion path of the chambers
D direction of rotation
F solid portions, mini-tablets, micro-tablets, globules
L longitudinal axis
N upper level of the bulk body
$N_1$ high level of the chamber
$N_2$ low level of the chamber
$N_0$ base level
S bulk body
Sk secant

The invention claimed is:

1. A device for singularized dispensing of solid portions forming a bulk body present at least partially in the device, the device having a longitudinal axis L extending the major length thereof and comprising at least two components, of which a first component forms a segregating device and a second component forms a singularizing device that can be rotated vis-à-vis the segregating device, wherein the singularizing device comprises an interior area and on one inner side of the singularizing device at least one chamber for accommodating one respective solid portion, so that the at least one chamber can be moved in a direction of motion during rotation of the singularization device about a rotational axis and on a circular motion path through the bulk body vis-à-vis the segregating device, so that one respective solid portion can be accommodated therein, wherein the segregating device further comprises a separating device, which extends parallel to a plane which comprises the circular motion path of the at least one chamber that extends up to an area above the bulk body, so that the at least one chamber on the path section can be closed by means of the separating device thereby preventing that any solid portions contained therein drop out, wherein a transfer path for accommodating the solid portions dropping out of the chambers follows the path section in the direction of motion, wherein the longitudinal axis L extends through the singularizing device interior area, and wherein the interior area accommodates the bulk body, and wherein the rotational axis of the singularization device is positioned essentially perpendicularly to the longitudinal axis of the device for dispensing the solid portions.

2. The device according to claim 1, characterized in that the transfer path terminates in a receiver for accommodating and counting the solid portions.

3. The device according to claim 2, characterized in that the receiver permits stacking the solid portions individually and on top of one another.

4. The device according to claim 2, characterized in that a dosing scale is located on the receiver, by means of which the number of the solid portions located in the receiver can be read.

5. The device according to claim 2, characterized in that the receiver is supported pivotable in the device, wherein the receiver is in an actuation position for singularizing the solid portions and transferring them into the receiver in a central swivel position and for actuating the device for left-handed or right-handed persons in each case in a delivery position for dispensing the solid portions from the device in a first lateral swivel position, which is swiveled in a first swivel direction vis-à-vis the actuation position, or is in a second lateral swivel position, which is swiveled in a second swivel direction vis-à-vis the actuation position.

6. The device according to claim 2, characterized in that an overflow route for the solid portions is located above the receiver, by means of which the solid portions can arrive at the bulk body of the solid portions.

7. The device according to claim 1, characterized in that the separating device is formed by a partition wall.

8. The device according to claim 1, characterized in that the device is designed to be connected to the discharge opening of a storage container for the solid portions.

9. The device according to claim 1, characterized in that the rotation of the singularizing device vis-à-vis the segregating device can be blocked by means of an anti-rotation stop.

10. The device according to claim 9, characterized in that the anti-rotation stop is formed by a locking element, which is attached torsion-proof to one of the two components and by means of which locking element the rotation can be blocked by means of at least one profile that engages in corresponding cutouts on the other component.

11. The device according to claim 1, characterized in that the singularizing device and the segregating device can be reciprocally rotated by means of a ratchet track on one of the two components and a latch element engaging with the ratchet track on the other of the two components by a fixed angular value in each case, wherein the fixed angular value corresponds to the spacing of two consecutive chambers in the motion path.

12. The device according to claim 1, characterized in that areas situated between the chambers are formed by running surfaces for the solid portions on the inner side of the singularizing device, which extend from a high level above a chamber base of a respective first chamber to a low level above a chamber base of a second chamber adjacent to the first chamber in a direction of rotation of the singularizing device.

13. The device according to claim 3, characterized in that a dosing scale is located on the receiver, by means of which the number of the solid portions located in the receiver can be read.

14. The device according to claim 3, characterized in that the receiver is supported pivotable in the device, wherein the receiver is in an actuation position for singularizing the solid portions and transferring them into the receiver in a central swivel position and for actuating the device for left-handed or right-handed persons in each case in a delivery position for dispensing the solid portions from the device in a first lateral swivel position, which is swiveled in a first swivel direction vis-à-vis the actuation position, or is in a second lateral swivel position, which is swiveled in a second swivel direction vis-à-vis the actuation position.

15. The device according to claim 4, characterized in that the receiver is supported pivotable in the device, wherein the receiver is in an actuation position for singularizing the solid portions and transferring them into the receiver in a central swivel position and for actuating the device for left-handed or right-handed persons in each case in a delivery position for dispensing the solid portions from the device in a first lateral swivel position, which is swiveled in a first swivel direction vis-à-vis the actuation position, or is in a second lateral swivel position, which is swiveled in a second swivel direction vis-à-vis the actuation position.

16. The device according to claim 15, wherein an overflow route for the solid portions is located above the receiver, by means of which the solid portions can arrive at the bulk body of the solid portions;

wherein the separating device is formed by a partition wall;

wherein the device is designed to be connected to the discharge opening of a storage container for the solid portions; and wherein the rotation of the singularizing device vis-à-vis the segregating device can be blocked by means of an anti-rotation stop.

17. The device according to claim 4, wherein the twisting of the singularizing device vis-à-vis the segregating device can be blocked by means of an anti-rotation stop; and wherein the anti-rotation stop is formed by a locking element, which is attached torsion-proof to one of the two components and by means of which locking element the rotation can be blocked by means of at least one profile that engages in corresponding cutouts on the other component.

18. The device according to claim 1, wherein the singularizing device and the segregating device can be reciprocally rotated by means of a ratchet track on one of the two components and a latch element engaging with the ratchet track on the other of the two components by a fixed angular value in each case, wherein the fixed angular value corresponds to the spacing of two consecutive chambers in the motion path; and wherein areas situated between the chambers are formed by running surfaces for the solid portions on the inner side of the singularizing device, which extend from a high level above a chamber base of a respective first chamber to a low level above a chamber base of a second chamber adjacent to the first chamber in a direction of rotation of the singularizing device.

19. A device for singularized dispensing of solid portions forming a bulk body present at least partially in the device, comprising at least two components, of which a first component forms a segregating device and a second component forms a singularizing device that can be rotated vis-à-vis the segregating device, wherein the singularizing device comprises an interior area and on one inner side of the singularizing device at least one chamber for accommodating one respective solid portion, so that the at least one chamber can be moved in a direction of motion during twisting of the singularization device and on a motion path through the bulk body vis-à-vis the segregating device, so that one respective solid portion can be accommodated therein, wherein the segregating device further comprises a separating device, which extends parallel to a path section of the motion path of the at least one chamber that extends up to an area above the bulk body, so that the at least one chamber on the path section can be closed by means of the separating device thereby preventing that any solid portions contained therein drop out, wherein a transfer path for accommodating the solid portions dropping out of the chambers follows the path section in the direction of motion;

wherein the transfer path terminates in a receiver for accommodating and counting the solid portions;

wherein the receiver permits stacking the solid portions individually and on top of one another;

wherein a dosing scale is located on the receiver, by means of which the number of the solid portions located in the receiver can be read;

wherein the receiver is supported pivotable in the device, wherein the receiver is in an actuation position for singularizing the solid portions and transferring them into the receiver in a central swivel position and for actuating the device for left-handed or right-handed persons in each case in a delivery position for dispensing the solid portions from the device in a first lateral swivel position, which is swiveled in a first swivel direction vis-à-vis the actuation position, or is in a second lateral swivel position, which is swiveled in a second swivel direction vis-à-vis the actuation position;

wherein an overflow route for the solid portions is located above the receiver, by means of which the solid portions can arrive at the bulk body of the solid portions;

wherein the separating device is formed by a partition wall;

wherein the device is designed to be connected to the discharge opening of a storage container for the solid portions;

wherein the twisting of the singularizing device vis-à-vis the segregating device can be blocked by means of an anti-rotation stop;

wherein the anti-rotation stop is formed by a locking element, which is attached torsion-proof to one of the two components and by means of which locking element the twisting can be blocked by means of at least one profile that engages in corresponding cutouts on the other component;

wherein the singularizing device and the segregating device can be reciprocally rotated by means of a ratchet track on one of the two components and a latch element engaging with the ratchet track on the other of the two components by a fixed angular value in each case, wherein the fixed angular value corresponds to the spacing of two consecutive chambers in the motion path; and wherein areas situated between the chambers are formed by running surfaces for the solid portions on the inner side of the singularizing device, which extend from a high level above a chamber base of a respective first chamber to a low level above a chamber base of a second chamber adjacent to the first chamber in a direction of rotation of the singularizing device.

20. A method for singularized dispensing of solid portions forming a bulk body by use of the device according to claim 1, comprising:

(a) providing the bulk body of the solid portions so that the bulk body is situated at least partially in an interior area of a singularizing device of the device;

(b) accommodating respectively one solid portion in one of multiple chambers, which are situated on one inner side of a singularizing device of the device;

(c) lifting the chambers filled respectively with one solid portion sequentially out of the bulk body; and (d) emptying each of the chambers filled with one solid portion following the respective lifting out of the bulk body, transferring the solid portions onto a transfer path and withdrawing the solid portions that have reached the transfer path from the interior area of the singularizing device.

* * * * *